US005158491A

United States Patent [19]

Fendley et al.

[11] Patent Number: 5,158,491

[45] Date of Patent: Oct. 27, 1992

[54] SYSTEM OF PRINTING STANDARDIZED CATHODE RAY TUBE SCREENS

[75] Inventors: James R. Fendley, Arlington Heights; John M. Jarosz, Skokie; Howard G. Lange, Prospect Heights; Kazimierz Lapinski, Palatine; Yong S. Park, South Barrington; Charles J. Brazak, III, Elmhurst, all of Ill.

[73] Assignee: Zenith Electronics Corporation, Glenview, Ill.

[21] Appl. No.: 655,561

[22] Filed: Feb. 13, 1991

Related U.S. Application Data

[60] Continuation-in-part of Ser. No. 562,523, Aug. 3, 1990, Pat. No. 5,059,147, which is a division of Ser. No. 370,204, Jun. 22, 1989, Pat. No. 4,973,280, which is a continuation-in-part of Ser. No. 223,475, Jul. 22, 1988, Pat. No. 4,902,257.

[51] Int. Cl.[5] ..... H01J 9/227

[52] U.S. Cl. ..... 445/66; 445/52; 430/5; 430/24; 269/266

[58] Field of Search ..... 445/4, 30, 52, 66; 430/5, 25, 23, 24; 313/407, 408; 51/317, 383, 216 R; 269/266

[56] References Cited

U.S. PATENT DOCUMENTS

| | | | |
|---|---|---|---|
| 2,733,366 | 1/1956 | Grimm et al. | 445/36 X |
| 3,894,321 | 7/1956 | Moore | 445/30 |
| 3,973,964 | 8/1976 | Lange | 430/23 X |
| 4,088,312 | 5/1978 | Frosch et al. | 269/266 X |
| 4,475,797 | 10/1984 | Park | 354/1 |
| 4,695,523 | 9/1987 | Palac | 430/23 |
| 4,884,006 | 11/1989 | Prazak | 313/477 R |
| 4,891,544 | 1/1990 | Capek et al. | 313/407 |
| 4,902,257 | 2/1990 | Adler et al. | 445/30 |
| 4,908,995 | 3/1990 | Dougherty et al. | 51/281 R |
| 4,979,920 | 12/1990 | Nrerenberg | 445/3 X |
| 5,025,191 | 6/1991 | Fendley | 313/408 X |

*Primary Examiner*—Kenneth J. Ramsey
*Attorney, Agent, or Firm*—Roland W. Norris

[57] ABSTRACT

A system for standardized printing of CRT screens is disclosed. A preferred embodiment utilizes a standardized photoexposure stencil made without the use of a shadow mask aperture pattern and projection printing. The stencil is then placed in proximity to the screening surface during exposure. Front panel and mask support topography preparation methods and apparatus are disclosed, as are means and methods for compensating for variations among panel assemblies utilized in standardized printing of the screens. The system thereby produces high resolution screens which may accept interchangeable shadow masks.

45 Claims, 15 Drawing Sheets

SYSTEM OF PRINTING STANDARDIZED CATHODE RAY TUBE SCREENS

This application is a continuation-in-part of copending application Ser. No. 562,523, Filing Date: Aug. 3, 1990; now U.S. Pat. No. 5,059,147 which is in turn a division of Ser. No. 370,204, File date: Jun. 22, 1989, now U.S. Pat. No. 4,973,280; which is a continuation-in-part of Ser. No. 223,475, filed Jul. 22, 1988, now U.S. Pat. No. 4,902,257.

CROSS REFERENCE TO RELATED APPLICATIONS

"Conformable Anvil For Supporting In-Process Face Panels of Tension Mask Color Cathode Ray Tubes", Filing Date: Nov. 12, 1990, Ser. No. 07/612,651; "Correctively Deforming Panel Structure", Filing Date: Dec. 26, 1990; Ser. No. 07/634,270; and "Method and Apparatus for Direct Contact Printing Screens on CRT Faceplates", Ser. No. 654,843 filed Jan. 13, 1991; all commonly owned by the assignee hereof.

BACKGROUND OF THE INVENTION

1. Field of the Invention

The present invention relates generally to the deposition of image producing screens for cathode ray tubes (CRTs). Most particularly, the present invention relates to screen application, also referred to as screening, by photoexposure of the screen elements using a standardized photographic stencil, or artwork plate, placed in proximity to a screening surface of a CRT front panel, or faceplate, during the photoexposure.

2. Discussion of the Related Art

CRTs or tubes are commonly screened today through a mated-mask process wherein a shadow mask is placed in its actual operational position at a distance "Q" from the front panel and used as the photographic "stencil" for the photoexposure deposition of the screen elements on one CRT panel. This technique, wherein the stencil is placed at, or substantially at, the "Q" distance is denominated as "projection" printing. As used herein the term "photostencil" or "stencil" will refer to an impervious material having a transmissive aperture pattern for the purpose of allowing radiant emissions to pass therethrough onto photosensitive layers of CRT screen elements in order to create a desired matrix, or pattern, of screen elements. The term "stencil" should not be taken to mean an apertured, or perforate, negative pattern designed to reproduce screen elements of the exact size and placement as the apertures in one to one correspondence onto the screen surface substrate of the CRT.

In general, the screen is formed by serial deposition and exposure of photosensitive slurries of the grille and phosphor materials deposited on a screening surface of the front panel of the CRT. The projection photoexposure process uses light directed through a lens to simulate the path of electron beams in the assembled tube. Thus, the exposure light is used to form the phosphor elements, and the electron beams impinge upon these phosphor elements to produce an image. The panel and mask are, of necessity, mated, or dedicated to each other, throughout the CRT assembly process so that when the CRT is assembled, the mask used to form the screen through photoexposure is also the mask used to control placement of the phosphor-exciting electron beams in tube operation. Thus, screen placement of the phosphors by photoexposure through the mask, corresponds, or registers, with the electron beam placement on the phosphors, which is also controlled through the same shadow mask. Hence, no misregistration between mask apertures and phosphor deposits occurs during tube operation and a suitable image is produced by the screen.

Projection photoexposure screening utilizing a mated mask and screen presents logistical problems, with associated manufacturing expense, in keeping the mask and screen together at all relevant times.

Also, due to diffusion and diffraction effects of projection photoexposure screening, the processing and photochemistry parameters must be tightly controlled in order to achieve acceptable yields of screens. Further, using the common screen element photochemistry and projection exposure techniques there is likely an absolute limit on the number of discrete individual phosphor dots which can be placed on the screen before morphological distortion of the discrete screen elements, e.g. phosphor dots, will cause the elements to run together. This limitation is particularly significant because higher resolution tubes towards which the industry is moving, must have a greater number of smaller phosphor dots or lines on the same screening surface area. For example, a current fourteen inch diagonal measure high resolution monitor has approximately 2.4 million phosphor dots, whereas proposed high resolution tubes may require about 5.5 million dots in the same screen area.

As shown in U.S. Pat. No. 4,248,947 to Oikawa, contact photoexposure screening uses a standardized, or master, exposure pattern for all tubes in the screening process. A plate carrying the master pattern is placed directly in contact with the screen elements, i.e. the grille and phosphor components, and allows for exposure of the screen element composition layers by use of floodlights. Contact exposure thus eliminates the need for a corrective lens and other such optical controls which are used to make the exposure light conform to electron beam behavior during exposure. This is because the light, or other radiant emissions, used to develop the screen can only land in one place on the screen, i.e., directly beneath the photostencil apertures. However, because of this, contact exposure requires very close attention to the physical dimensions of the tube during manufacture because of the difficulty in compensating for changing mask and screen geometry, and consequent electron beam misregistration, due to dimensional irregularities between tubes. Any change in mask or screen geometry when using a standardized stencil may result in electron beam misregistration on the screen, causing color impurities in the image.

Further, in contact photoexposure the standardized photostencil may remove portions of the screen element slurry which adhere to it, necessitating frequent and thorough cleaning of the stencil in order to avoid deposition of the adhered slurry on subsequent screens or subsequent mispositioning of the stencil due to the adhered slurry acting as a spacer on the stencil.

An early system which places a standard photographic stencil in near contact, or proximity, to the screening surface, which will be understood to be coated with a layer of photosensitive screen element composition during exposure, has been described in U.S. Pat. No. 3,973,964 issued to Howard A. Lange. The above-cited parent disclosure, U.S. Pat. No.

4,902,257 issued to Robert Adler et al., also of common ownership herewith, suggests a proximity printing apparatus offering the advantage of screen element placement compensation according to varying tube dimensions during exposure, while reducing undesirable diffusion and diffraction problems. Both of these systems seek to achieve a CRT using interchangeable screens and masks wherein any front panel may be mated with any mask to create an optimally functional CRT.

As noted in the above-cited parent disclosure proximity printing may be utilized without resort to "rail" height references when the Q height is held to a very close tolerance. As also noted, this Q height tolerance control may be alleviated significantly where the proximity print process utilizes the rail height for setting the proximity distance hereinafter sometimes referred to as Q', between the photostencil and the screening surface. As further noted therein, offset printing of a standardized screen may require special control of the accuracy of the Q height. Thus, a variety of apparatus and methods may be utilized depending upon the standardized screening method selected.

By combining a proximity printing system with a simplified tube geometry such as exists in the flat tension mask technology of the present owner's unique CRT's (see FIG. 1), high resolution screens may be made with well understood processes and chemistries to improve yields while effecting economies in time and materials previously not possible. References illustrating aspects of tube manufacture which also may be of interest herein include: Oikawa, U.S. Pat. No. 4,248,947; Fiore, U.S. Pat. No. 3,676,914; Fischer-Colbrie, U. S. Pat. No. 2,842,696; and Grimm et al., U.S. Pat. No. 2,733,366.

OBJECTS OF THE INVENTION

It is an object of the present invention to provide a system i.e., apparatus or method or both, for screening CRT front panels for use with interchangeable shadow masks, in an economical manner with high yields, and high throughput.

It is a further object of the present invention to provide a system for screening high resolution CRT front panels of the flat tension mask variety utilizing proximity photoprinting techniques.

It is a further object of the present invention to provide a photoexposure system for screening CRT front panels which minimizes or eliminates morphological distortion of screen elements due to utilization of projection printing processes.

Other attendant advantages will be more readily appreciated as the invention becomes better understood by reference to the following detailed description and considered in connection with the accompanying drawings in which like reference numerals designate like parts throughout the figures. It will be understood that certain features of the invention may be exaggerated in the figures for explanatory purposes.

DESCRIPTION OF PREFERRED EMBODIMENTS

Figure 1:
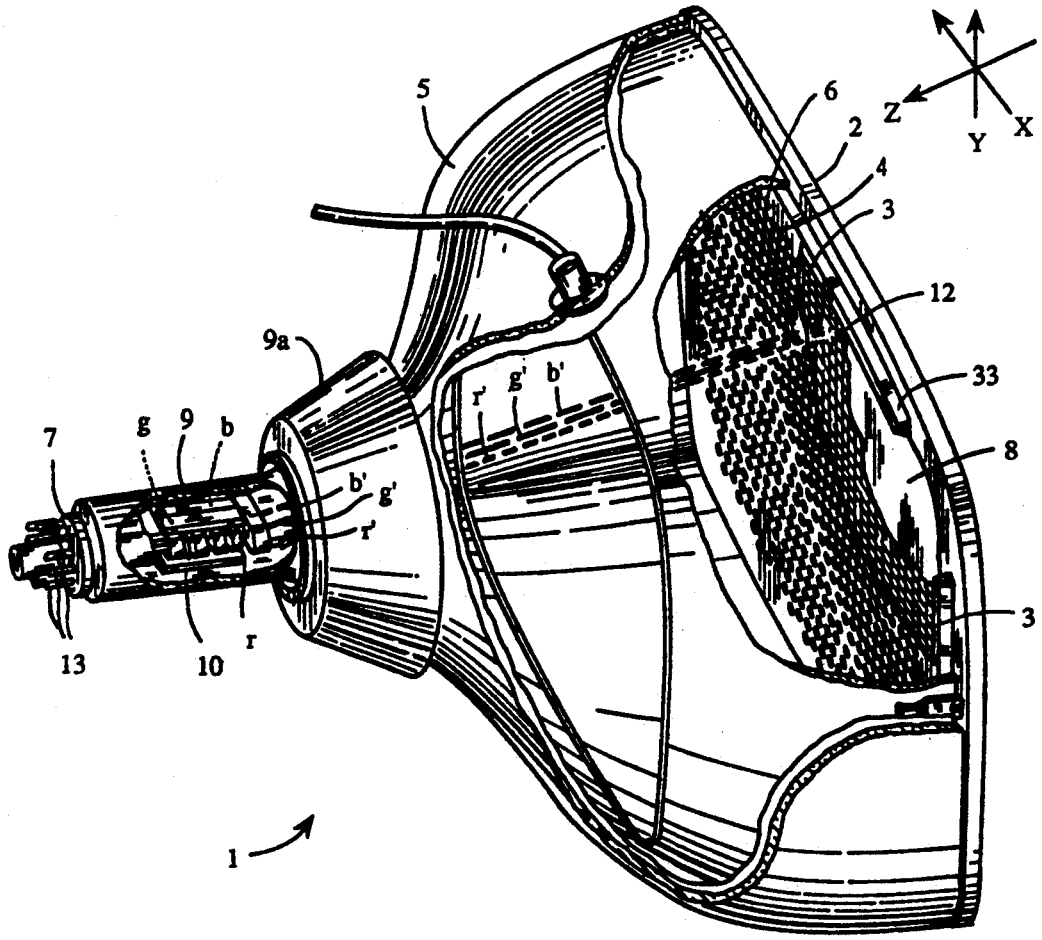
FIG. 1 illustrates a cathode ray tube of the flat tension mask (FTM) variety.
Figure 2:
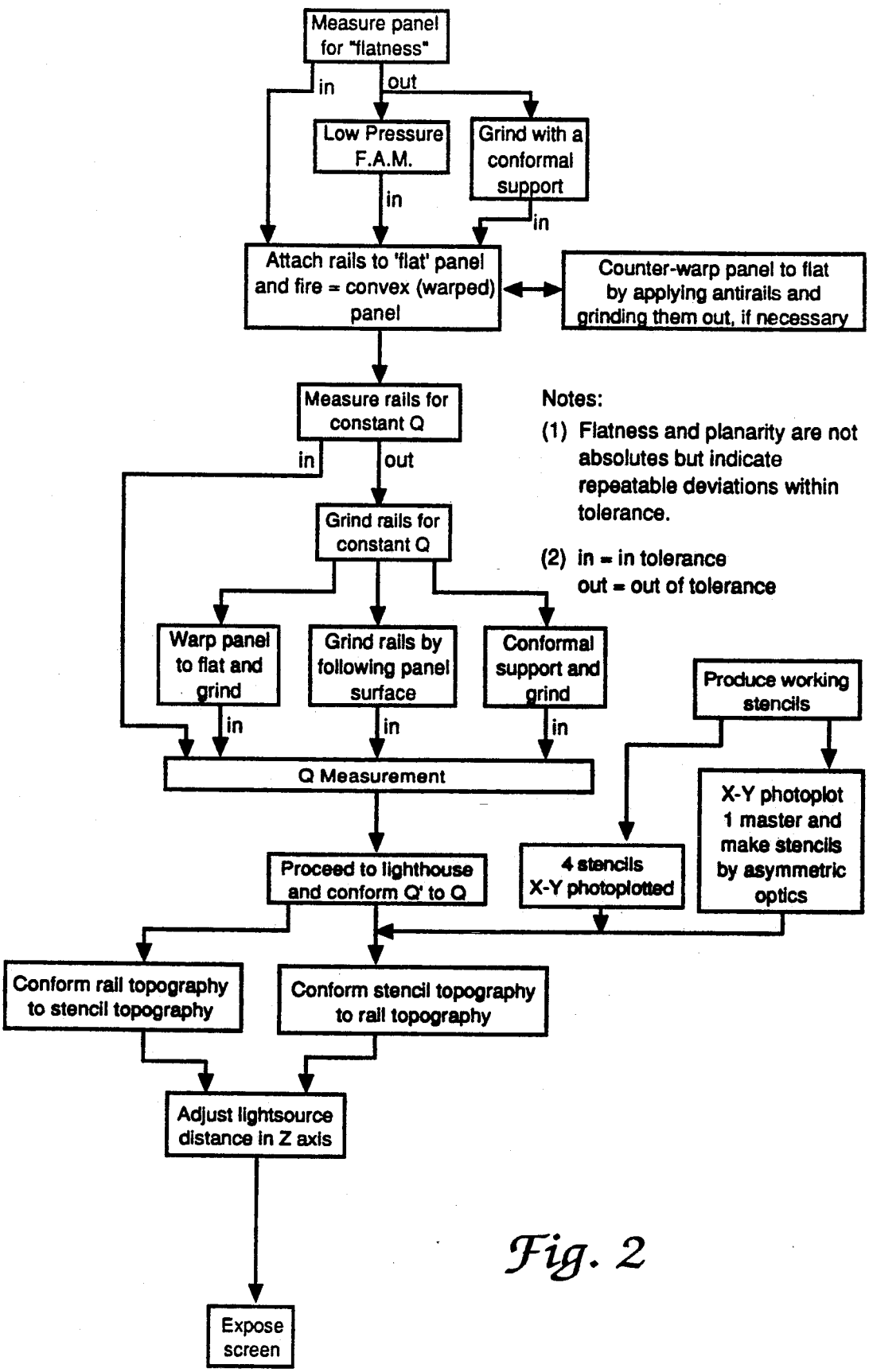
FIG. 2 is a flow chart illustrating various aspects of a proximity print system for flat front panels.

FIG. 1 depicts a flat tension mask color cathode ray tube 1, as for example a 14 inch diagonal measure color monitor which will be used as a reference for the dimensions cited hereinafter. The tube 1 includes a glass front panel 2 defining the X and Y axes, or horizontal and vertical of the tube. The panel 2 is hermetically sealed to an evacuated envelope 5 extending in the Z-axis of the tube 1 to a neck 9 and terminating in a connection plug 7 having a plurality of stem pins 13.

Internal parts include a mask support structure, or rails 33, permanently attached to the inner surface 8 of the panel 2 which supports a tension shadow mask 4. The mask support surfaces 3 of the rails 33 are commonly machine ground to provide a planar surface at fixed distance from the plane of the inner, or screening, surface 8. This distance from the shadow mask 4 to the screening surface 8 is commonly referred to as the "Q" distance or height. In the case of a flat mask and screen of the preferred embodiment, "Q" is also the distance between mask support surface 3 and the screening surface 8. It will be appreciated that the front panel and mask geometry may be other than flat, e.g. cylindrical, and that a key element of tube manufacture lies in the repeatability of a predetermined screening surface curvature, whether of finite or infinite radius, instead of the specific type or amount of curvature selected. On the inner surface 8 of the panel 2 is deposited a screen 12 typically comprising the elements of a black grille and a pattern of colored-light emitting phosphors distributed across the expanse of the inner surface 8 within the inner boundaries of the rails 33. The phosphors 12, when excited by the impingement of an electron beam, emit red, green and blue light.

The shadow mask 4 has a large number of beam-passing apertures 6 and is permanently affixed, as by laser welding, to the ground mask support surface 3 of the rails 33.

In the neck 9 of the tube 1 is installed a cluster 10 of three electron guns identified as r, g and b. The electron guns emit three separate electron beams designated as r', g' and b' directed toward the mask 4. The electron beams are electronically modulated in accordance with color picture signal information. Deflected by magnetic fields produced by a yoke 9a external to the tube, the electron beams r', g', and b' are caused to scan horizontally and vertically such that the entire surface of the mask 4 is swept in a periodic fashion to form an image extending over substantially the entire area of the screen 12.

At positions on the mask 4 where there is an aperture 6, each of the three electron beam passes through the mask and impinges on the screen 12. Thus, the position of the mask 4 with its pattern of apertures 6, the positions of the electron guns r, g and b at 10, and the height of the rails 33 or mask support surface 3, control the locations where the electron beams r', g' and b' impinge on the screen 12. For proper operation of the tube 1, there must be on the screen 12, a light emitting phosphor deposit of the proper color characteristic corresponding to the color information of the impinging electron beam r', g' or b'. Further, for proper operation and color purity, the center of the area of impingement of the electron beam must coincide, or register, within a narrow tolerance with the center of the associated phosphor deposit.

The rectangular area within which images are displayed, i.e. the area covered by the electron beams on the screen, is larger than the corresponding area on the mask through which those electron beams pass; the linear magnification from mask to screen being on the order of a few percent. Detailed studies have shown that this magnification varies slightly across the screen. Therefore, when a phrase such as "registration between the aperture pattern of the mask and the screen pattern" is used in this specification, registration does not mean that the two patterns are congruent like a photographic negative and its positive print. Rather, it means that the two patterns are related to each other as required in a color cathode ray tube using a support structure of predetermined height and having a predetermined spacing from mask to screen. Such registration of mask and screen is with respect to the electron beam center of deflection. The center of deflection, or apparent source of electrons, is different for each screen location because the electron beams are effected by the earth's magnetic field and other environmental fields. As noted, in color tubes of conventional construction, registration is facilitated by using shadow mask and front panel pairs.

It will be appreciated that the geometrical relationships of the operating tube parts must be maintained within close tolerances in order to preserve adequate color Good design practice calls for registration of electron beams and phosphor dots to be less than one half mil. This prevents beams from landing off the phosphor dots and from striking the wrong colored dots. Especially in the case of high resolution tubes, the physical parameters of the tube must be held within narrow tolerances, eg., less than one half mil; or compensation must be provided in the manufacture of the tube to ease these physical tolerances, or both. The system disclosed hereinafter seeks to utilize both approaches.

PANEL PREPARATION

Figure 3:
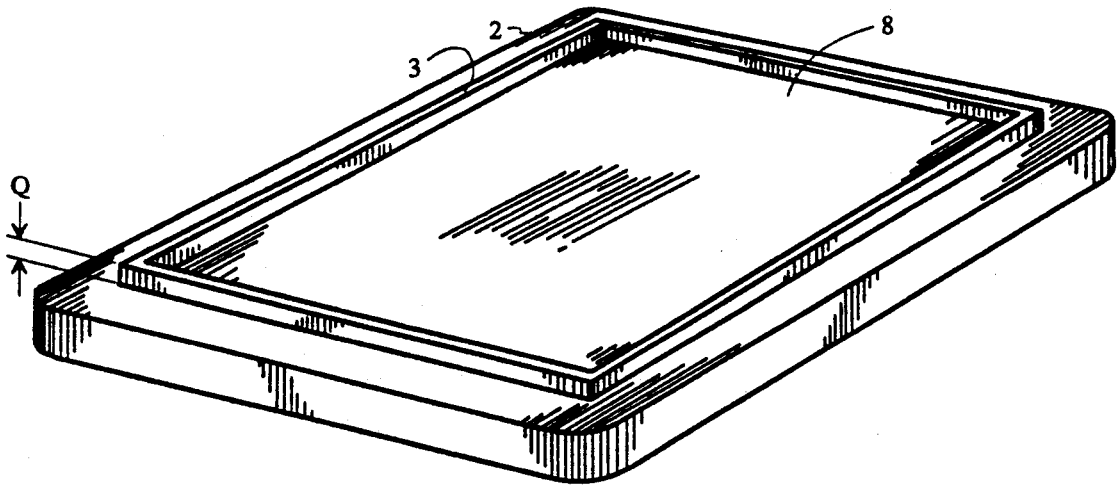
FIG. 3 illustrates the front panel, or faceplate of an FTM tube having mask support surfaces, or rails, attached thereto.
Figure 4:
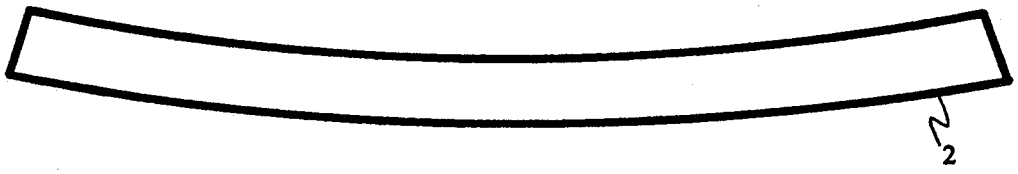
FIG. 4 illustrates a CRT front panel blank in a warped state.

As seen in FIG. 3, the face plate, or panel 2, of the CRT is in its ideal planar state with planar mask support surfaces 3 at a fixed distance, Q, from the screening surface 8. In practice, the glass of the front panel will be warped or deformed several mils, i.e., thousandths of an inch, from a true plane, as seen in FIG. 4. This is variously due to manufacturing tolerances, and/or glass sag since glass is not perfectly rigid.

In order to obtain screens suitable for use with interchangeable masks according to the preferred embodiment it is desirable from a manufacturing viewpoint to use as a standard starting point a panel that is flat to within ±0.25 mils. In comparison, panel flatness tolerances for projection printing flat screen tubes by the owner hereof are now about ±4.0 mils. Glass within this flatness tolerance may be obtained using float glass processing, as described in U.S. Pat. No. 4,816,053, co-owned herewith. More commonly, however, the standard panel sheet or press glass blanks must be further processed before being suitable for use in the making of the CRT. It will be appreciated that panel configurations other than flat may be used with the present invention so long as adequate repeatability of the curvature is attained.

Figure 5A:
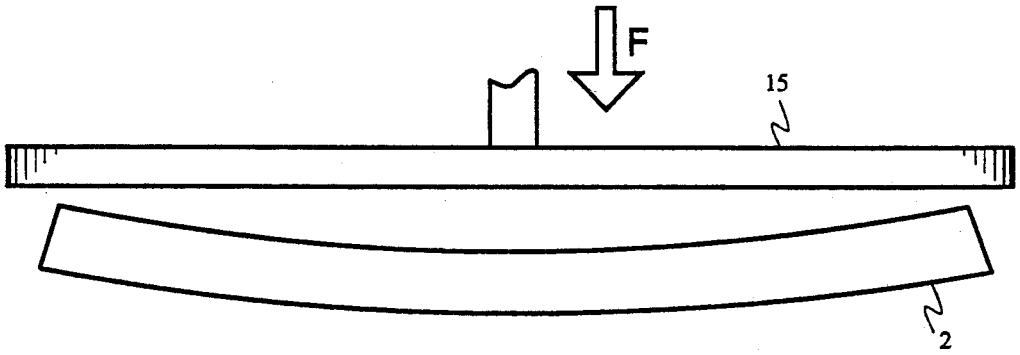
FIGS. 5A–D illustrate a method of obtaining a planar screening surface using low pressure free abrasive machining.
Figure 5B:
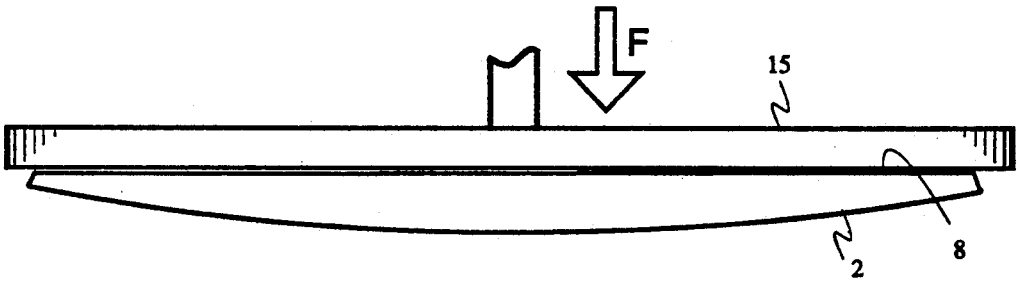
Figure 5C:
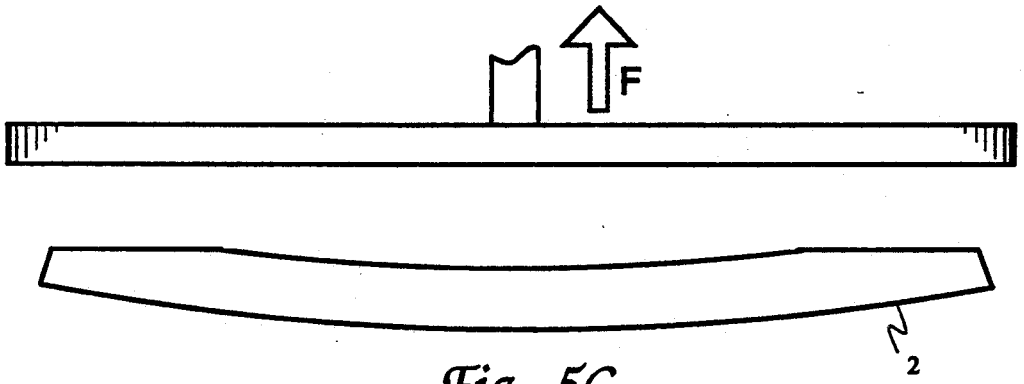
Figure 5D:
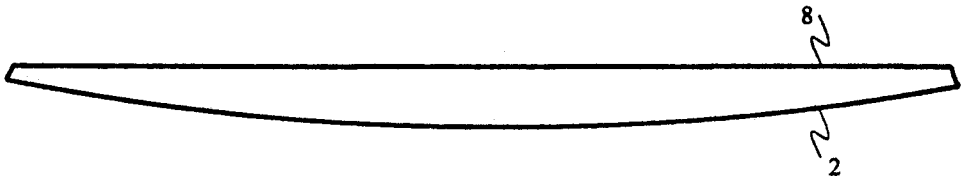

As seen in FIGS. 5A–5D, a free abrasive machining apparatus 15 such as described in U.S. Pat. No. 4,884,006, is used to grind the panel 2 to obtain a planar screening surface 8 by using a downfeed pressure F of approximately 1.5 p.s.i. rather than the standard three to five p.s.i. It will be realized that any excessive downfeed pressure F will deform and flatten the panel without grinding it completely, as seen in FIG. 5B. Once the pressure F is removed from the panel 2, the panel 2 will spring back to a non-planar position again, resulting in a non-planar screening surface 8, as illustrated in FIG. 5C. By using a low downfeed pressure, the grinding apparatus 15 will remove high spots on the panel 2 without consequent deforming of the panel to a plane. Thus, a planar screening surface 8 is formed regardless of the natural warp of the panel 2, as seen in FIG. 5D.

Figure 6:
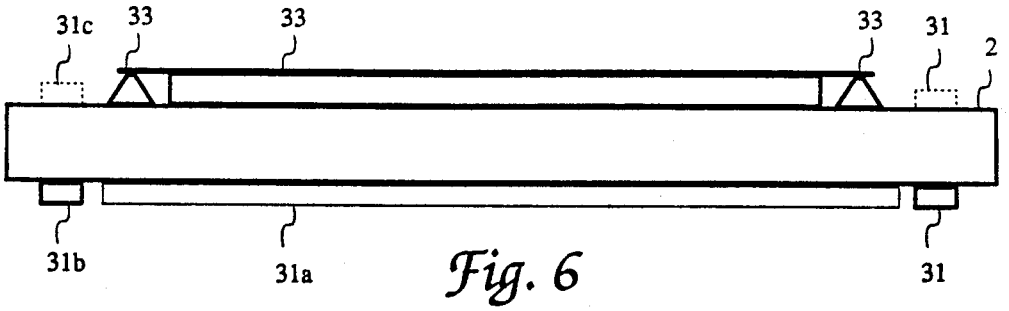
FIG. 6 illustrates a method of obtaining a planar screening surface using correctively deforming structures applied to the panel.

Alternatively, as seen in FIG. 6 a correctively deforming structure 31, or "anti-rail" may be applied to the front panel 2. The deforming structure 31 illustrated is a ceramic rail substantially like a ceramic composition of mask support rails 33, such as described in U.S. patent application Ser. No. 458,129 filed Dec. 12, 1989, and now U.S. Pat. No. 5,086,251 commonly owned herewith. The ceramic composition of the rails 33 and deforming structure 31 have a different coefficient of thermal expansion (CTE) than the glass of the front panel 2. During firing processes to secure these ceramic structures to the panel 2 with a devitrifying frit, and subsequent cooling, the ceramic structure and glass panel contract at different rates, thereby placing deformation forces on the panel. These deformation forces may be "tuned" through selectable placement of the deformation structures 31 and modification of the size and shape thereof, to conform the panel 2 to a plane. Alternatively, the deformation structures 31 may be made to "overwarp" the panel 2 and then be ground to bring the panel into plane. This process is more fully explained and claimed in Ser. No. 07/634,270; filed Dec. 26, 1990, commonly owned herewith.

Figure 7:
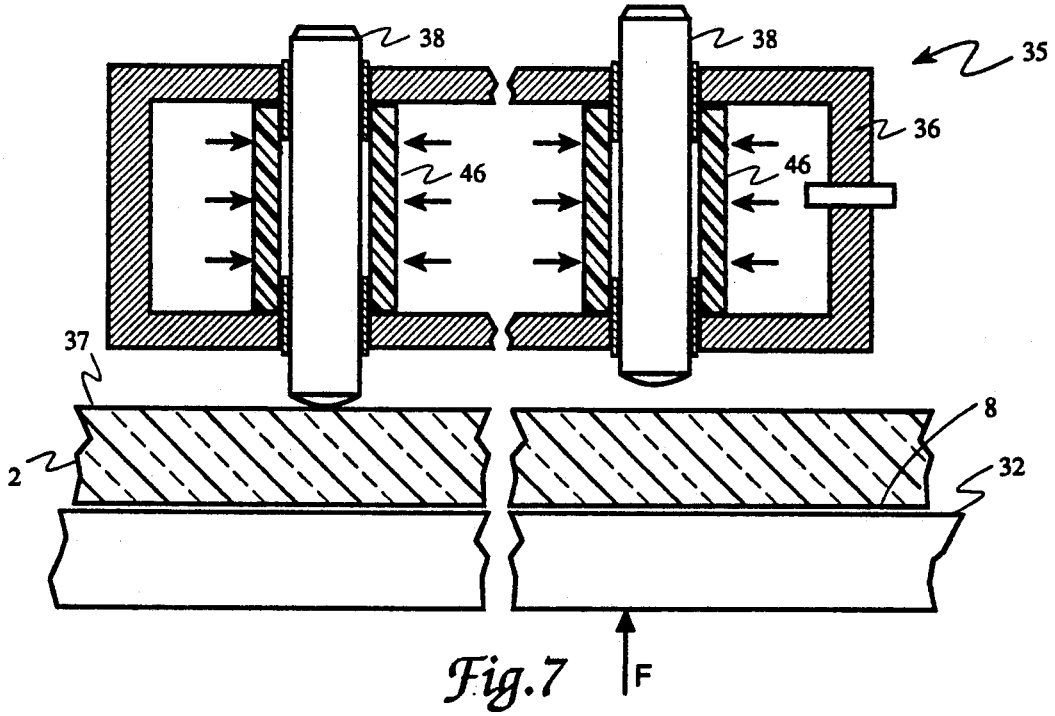
FIG. 7 illustrates a method of obtaining a planar screening surface using a conformable support during grinding of the panel.

Another alternative, as illustrated in FIG. 7 and more fully explained and claimed in the co-pending application, Ser. No. 07/612,651, filed Nov. 13, 1990, is to place a conformable support 35 on the outer surface 37 of the panel 2. The conformable support apparatus 35 comprises an anvil 36 having a configurable support structure comprising a plurality of Z-axis adjustable supports 38 for contacting and supporting the panel outer surface 37 without placing any deforming pressure thereon. The adjustable supports 38 may be positioned by gravity and fixed by compressible sleeves 46 or by any of a variety of means. The conformable support 35 is then used to hold the panel 2 against deformation by the force F of a grinding surface 32 during grinding operations to flatten the screening surface 8. Because the panel 2 is not deformed by the grinding pressure, undesirable springback of the panel to a warped topography will not occur.

Rail Grinding

Figure 8:
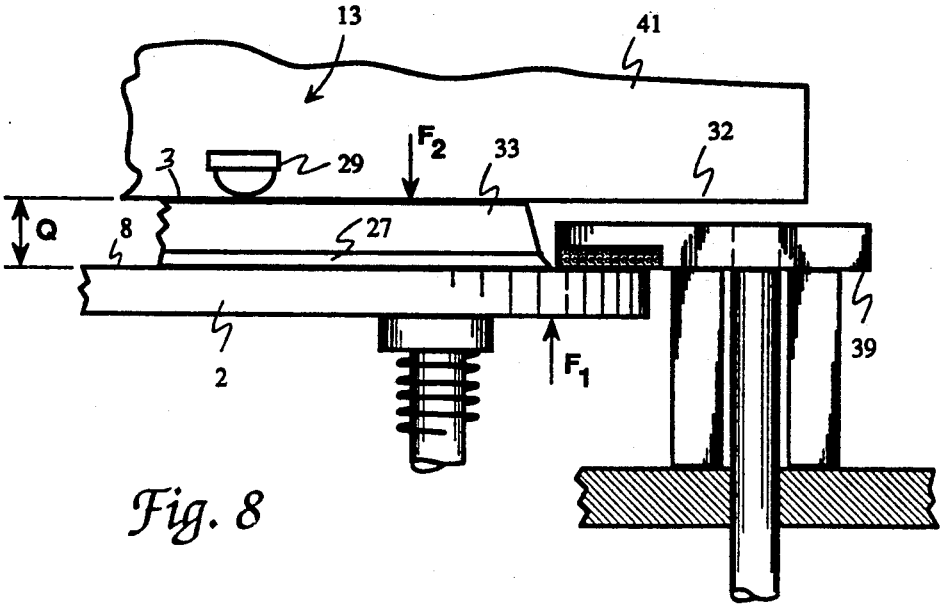
FIG. 8 illustrates a method of obtaining a planar mask support surface using an orbital-head grinding apparatus.

As seen in FIG. 8, once the panel 2 has been initially processed, if necessary, by one of the above methods, the mask support structures, shown as rails 33, are attached to the screening surface 8 of the panel 2 with a devitrifying frit 27 and a subsequent firing operation. The rails are then ground with a grinding surface 32 to prepare a suitable mask support surface 3 for later attachment of the mask. The mask support surface 3 will provide room for welding the mask thereto, as well as establish the mask-to-screen distance, "Q", and/or a planar mask support topography co-planar with the screening surface 8. Q height tolerance, or panel - to - panel consistency, of ±2 mils with ±0.5 mil flatness tolerance, or constancy within each panel, is desirable for use with the preferred embodiment. In comparison, current projection printing Q height tolerance is ±5 mils with ±0.5 mil rail flatness tolerance.

As seen in FIG. 8 the rail grinding may be accomplished in the manner disclosed in U.S. Pat. No. 4,908,995, commonly owned herewith. The panel 2 is held by a force F1 against a known reference surface 39. A planetary grinder head 41 then contacts the rails 33 by a force F2 to grind the rails to the proper "Q" height and rail topography. The rails 33 are then measured by a contact apparatus 29 to determine the actual "Q" height. Such a contact apparatus is more fully explained and claimed in the co-owned U.S. Pat. No. 4,828,524.

Figure 9A:
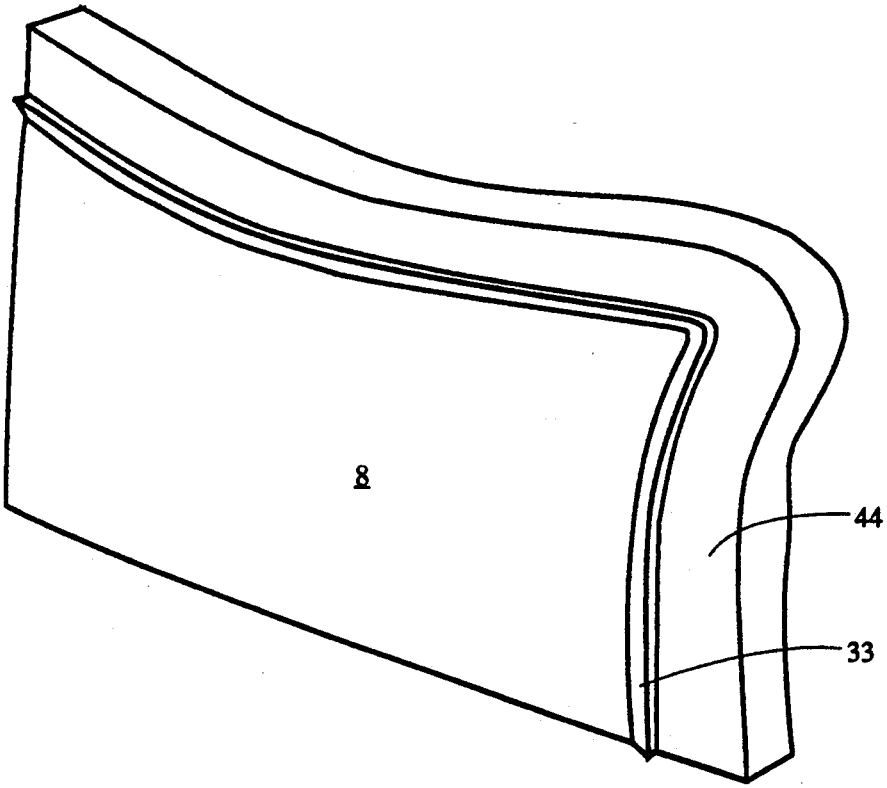
FIG. 9A illustrates a front panel warped by application of mask support rails having a lower coefficient of thermal expansion than that of the panel.
Figure 9B:
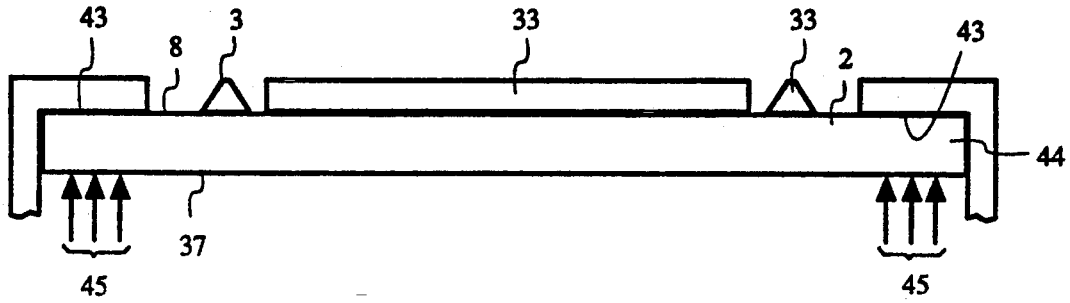
FIG. 9B illustrates a method of obtaining planar screening and mask support surfaces using temporary panel deformation forces.
Figure 10:
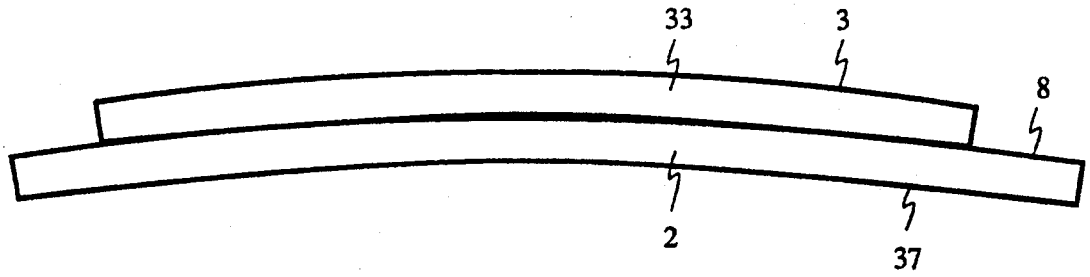
FIG. 10 illustrates a panel similar to that of FIG. 9A, with rails thereon which is deformed in a non-planar condition.

As seen in FIG. 9A, a panel screening surface 8 is normally caused to be warped convexly towards the rails 33 during attachment of the rails 33, as explained in connection with FIG. 5. In an alternative rail preparation embodiment seen in FIG. 9B, the periphery 44 of the panel 2 is conformed to a planar topography by fixturing the panel 2 beneath reference surfaces 43 substantially surrounding the panel on the panel inner surface 8, and applying a force 45 to the outer side 37 of the periphery 44, preferably at the panel corners. The force 45 is temporarily applied to hold the panel 2 planar against reference surface 43 during grinding of the rails 33 to establish a constant "Q" height at the rails. It has been determined that the rail height on a panel with two mils of initial convexity can be ground to within 0.12 mils of uniformity or constancy by using four thirty-five pound corner loads to flatten the panel. It is evident that upon removal of the force 45, the panel 2 will assume its original warped condition, as seen in FIG. 10. However, with the "Q" height (mask support surface-to-panel) constant, the non-planar topography of the panel 2 and mask support surface 3 may be compensated for during screen printing to more nearly match the screen 12 to the topography of the subsequently applied shadow mask 4, as further explained below. It will also be appreciated that, in using this method, the greatest "Q" (mask-to-screen) height deviations will normally occur in the central region of the screening area where they are less troublesome due to the lesser angle of deflection of the electron beams incident upon the screen in this region.

Figure 11:
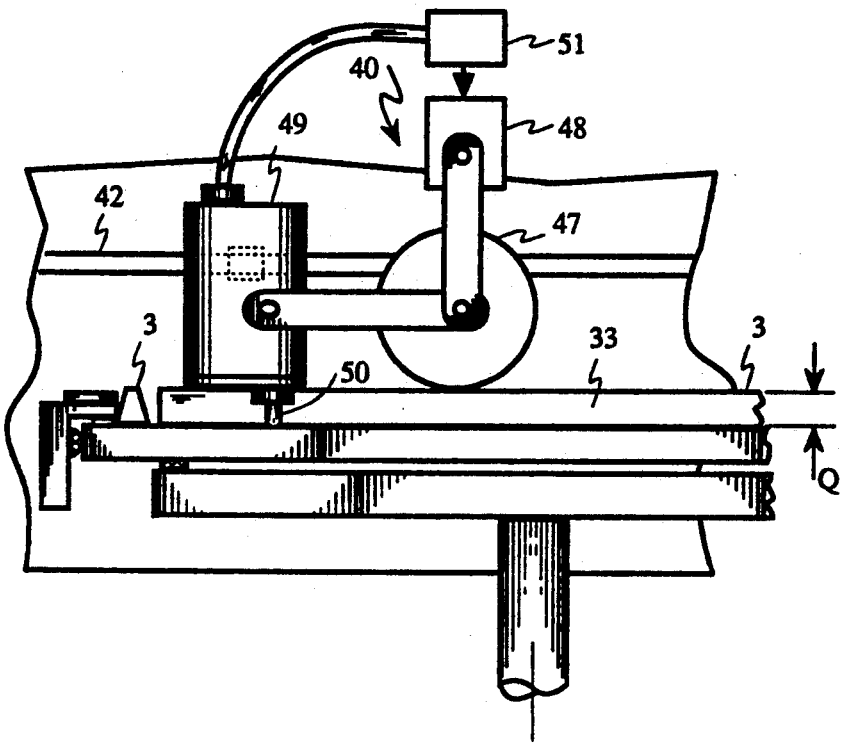
FIG. 11 illustrates a method of obtaining a constant Q height mask support surface using a rail-follower grinding apparatus.

As seen in FIG. 11, an alternative "rail-follower" rail grinding apparatus 40 includes a small grinder 47 suitably dimensioned to grind, in series, the mask support surface 3 of the rails 33. The grinding apparatus 40 is movably connected to a track 42 surrounding the panel 2 and to suitable motive means (not shown) to enable the grinding apparatus 40 to travel along the longitudinal axis of the rails 33. The grinder 47 is also movable in the Z-axis of the tube, i.e.. up and down in FIG. 11, by an actuator 48 which is connected physically and electronically to a rail height measuring device 49. The measuring device 49 includes a transducer 50. The measuring device 49 thereby generates signals through a controller 51. The controller then provides suitable time delays, height information, etc. for controlling Z-axis movement of the small grinder 47 to establish a constant "Q" height for the mask support surfaces 3 and consistent "Q" height from panel-to-panel.

During rail grinding operations it will be appreciated that the conformable support 35, as explained in conjunction with FIG. 7, may be used to support the panel 2 and prevent undesired panel deformation caused by forces transferred from the grinding apparatus to the panel.

It will be understood that these preparations for panel and mask support surface planarity and/or constant "Q" height are only necessary insofar as they are required by the deviant topography of the basic components. It will be further understood that the physical parameters of the panel and rail assemblies are often interdependent and may be used to compensate for one another during tube manufacture as necessary to achieve an adequately functional screen geometry. Careful control of basic component manufacture may initially yield panels and rails within suitable tolerance for use with proximity screen printing techniques.

Proximity Printing

It will now be assumed that panels 2 and mask support surfaces 3 with tolerable topography and "Q" height are supplied for screening of the panel 2 with the rails 33 attached thereto. Where panel and rail conditions exist that are less than optimal, these conditions will be specifically addressed.

Figure 12:
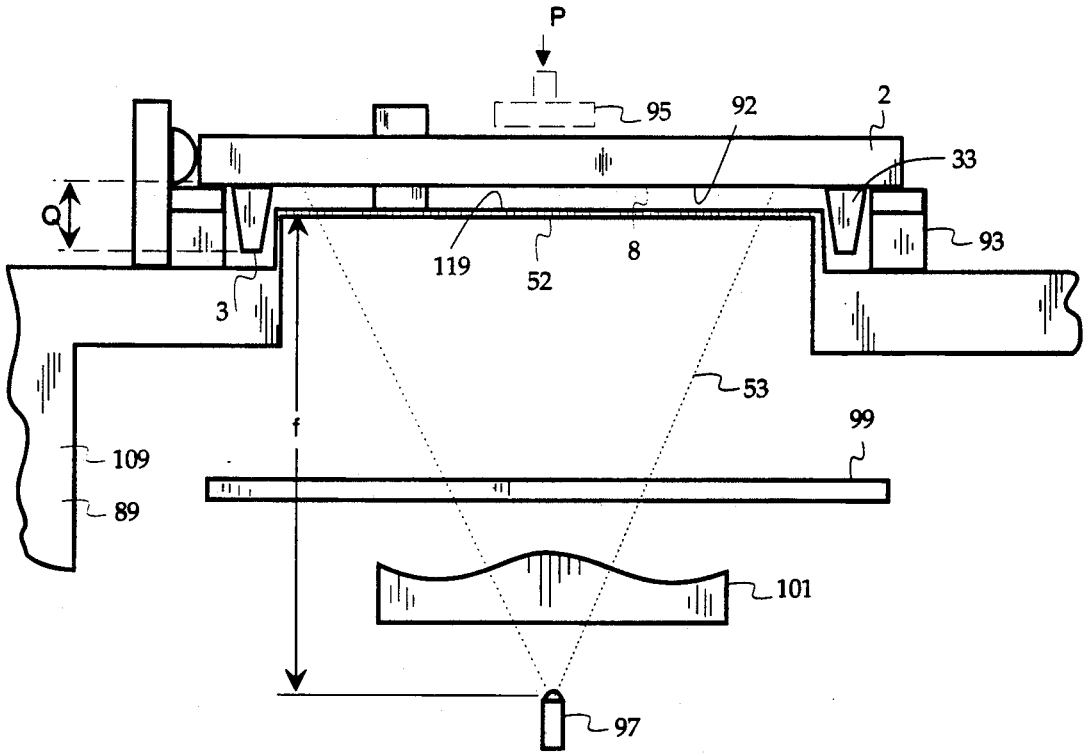
FIG. 12 illustrates a basic proximity printing apparatus for photo-deposition of a screen onto a flat panel.

As seen in FIG. 12 the basis for screen deposition by proximity printing lies in placing a standardized photostencil 52 in proximity to the exposure-targeted screening surface 8 to eliminate the adverse effects of diffusion and/or diffraction of the light used to define the screen elements. As used herein, "in proximity to" means spaced from about 1 to about 100 mils. This contrasts with normal "Q-distance" or projection exposure which, for the same screen size, would be approximately 250–320 mils spacing between the exposure stencil (the mated mask) and the screen-bearing panel surface.

In defining the range of proximity, or as sometimes denominated herein, the "Q'" distance, it is noted that any increase in "Q'" will result in some morphological distortion of the screen elements due in part to increased diffusion or penumbra, and diffraction effects. Morphological distortion will be defined as a change from that body definition of the designed screen element produced by photoexposure though the stencil aperture at design "Q'" distance as discussed below in conjunction with FIGS. 13A, 13B, 14A, and 14B. It is also noted that proper design of the proximity printing system will account for the size and power of the light source in achieving good distribution of radiant energy over the printing field at an intensity which allows adequate operator control of the process.

The range of proximity may, therefore, be defined as from, at the lowest value, "not touching the screen elements" to, at the upper value, a distance where penumbra and diffraction result in distorted screen element morphology. Penumbra zones greater than a few tenths of a mil are considered unacceptable distortions in the preferred embodiment.

As a practical matter the lower limit may be stated as the screen or slurry layer thickness taken in conjunction with the flatness tolerances of the panel screening surface and photostencil, e.g. 1.5 mil, and the upper limit at about 100 mils; with the preferable "Q'" value being 20 mils.

One consequent benefit of "proximity" printing is that it allows the use of higher powered light sources resulting in decreased exposure times, enabling one exposure apparatus, or lighthouse, to match the throughput of many lower powered apparatuses utilizing projection photoexposure.

Figure 13A:
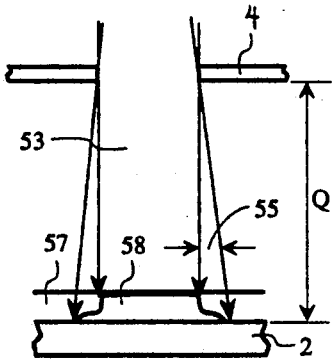
FIGS. 13A and 13B are cross sectional views of phosphor dots printed by projection printing and proximity printing, respectively, and illustrating the deleterious effects of exposure light diffusion and diffraction on screen element deposition.
Figure 14A:
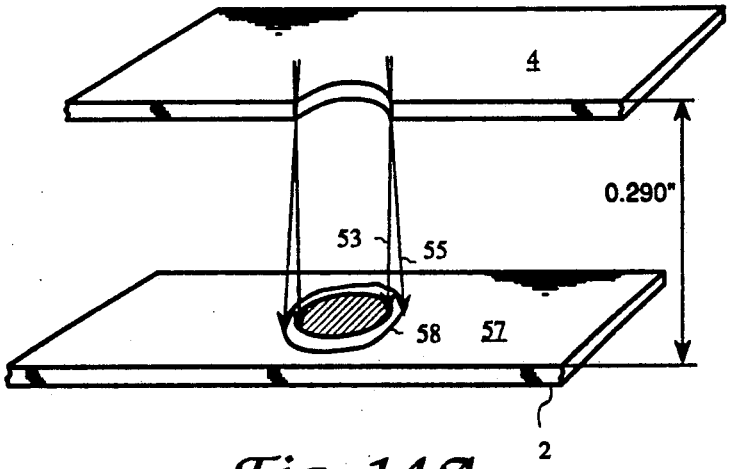
FIGS. 14A and 14B illustrate the decreased penumbra effects of proximity printing photoexposure.
Figure 13B:
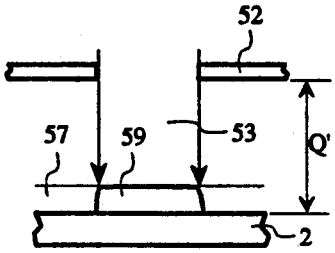
Figure 14B:
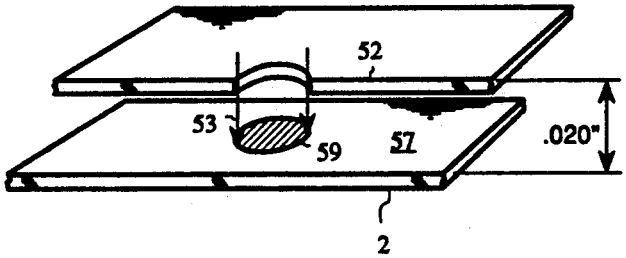

As seen in FIGS. 13A and B and 14A and B, a concurrent benefit of reduced light diffusion is a sharp reduction of deleterious penumbra effects on the size and shape of the discrete screen element 59, i.e. black grille or phosphor deposit, formed by a light beam 53. In FIGS. 13A and 14A illustrating projection photoexposure using the shadow mask 4 as a stencil; because the exposure light beam 53 will diffuse outwardly, as seen at ref. no. 55, after passage through the stencil 52, placed at a "Q" distance of 0.290 inches the beam 53 will have a non-uniform intensity as it impinges upon the photosensitive screen element composition layer, on slurry 57. In the region of diffuse light 55, the slurry 57 will not be as completely exposed, which may result in an irregular screen element shape 58 during subsequent screen development. As seen in FIGS. 13B and 14B, by placing the photostencil 52 in proximity to the slurry 57 at a "Q'" distance of 0.020 inches, the exposure beam 53 does not spread significantly before striking the slurry 57, thereby creating an even exposure and a regular screen element shape 59 having well defined edges.

It will be understood that the criticality of screen element morphology increases as a greater number of smaller screen elements, e.g. phosphor dots, are required in high resolution tubes.

Further, with increased light power for dot exposure and resultant lowered exposure times the criticality of manufacturing process parameters such as washing of the exposed slurry layer, exposure times, etc. are eased. For example, it is known that the phosphor particles within the slurry scatter the incident light resulting in radial growth of the deposited phosphor dot. Thus, a better defined light image will result in less light being scattered and a decrease of unwanted radial dot growth due to this scattering effect. Also, "back exposure" of the screen, wherein the phosphor slurry is exposed through the front surface of the panel to effect a better sticking of the dots 59 to the screening surface 8, is improved. In back exposure, the first phosphor deposited, typically the green-light -emissive one, fills in all grille holes upon back exposure resulting in a "green haze" which must be washed away from the grille apertures intended for blue and red light emissive phosphors. Too much light intensity in the back exposure will result in a green haze difficult to wash away, leading to cross contamination of the phosphors and possible rejection of the screen. Because the phosphor dots formed by higher intensity proximity exposure are more regularly shaped and more completely hardened, the washing of the green haze may be more vigorous, leading to less phosphor cross contamination and consequent screen rejections. Alternatively, the higher intensity light source may eliminate the need for back exposure altogether.

Figure 15:
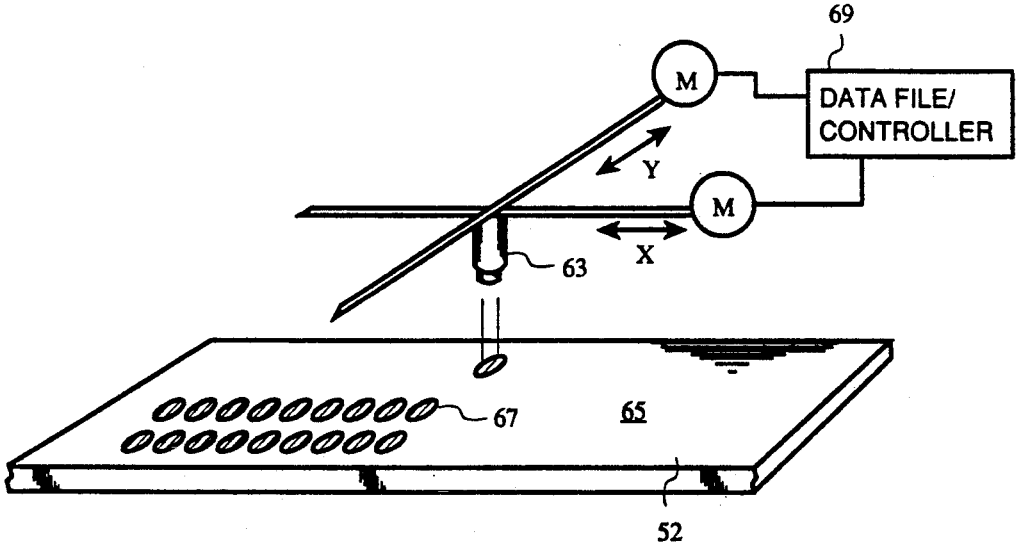
FIG. 15 illustrates a stencil producing method which eliminates projection printing diffusion problems by using an X-Y photoplotter.

As seen in FIG. 15, the standardized photoexposure stencil 52 or a master copy thereof, may be created using an X-Y photoplotter 63 to expose a photosensitive plate 65 in each desired aperture location. Such photoplotters are commercially available from Texas Instruments Corp., Model No. Argis One; or Gerber Scientific Instrument Co., PhotoPlotter Model No. 1434. One advantage in a photoplotter is that its optics will make the exposure aperture 67 in a predetermined and well defined size undegraded by traditional projection photoexposure techniques whose long exposure distances would introduce diffusion and/or diffraction irregularities into high resolution pattern photostencils. Also a variety of shapes such as circular, hexagonal, etc., may be created by the photoplotter.

A further advantage stems from the fact that each aperture is individually addressable by the controller 69. Therefore, the aperture matrix of the stencil and the resulting screen pattern may be varied to more adequately and easily simulate light beam landings duplicative of electron beam landings under actual operating tube parameters. For example, in creating a working lighthouse for a new tube model under current practice, several iterations must be performed on a compensating lens of the continuous type used to direct the exposure light beams before a suitable lens configuration is arrived at. This lens iteration process is lengthy and expensive due to sagging, optical grinding, and polishing in the making of successive iterations. Also the continuous compensating lens cannot correct for all registration errors between exposure light beam and electron beam landings, such as a rotational component of an electron beam landing known as curl errors, caused by magnetic effects on the electron beams. Segmented compensating lenses can correct curl errors, but are much more expensive.

Considering that the stencil is a separate element of the proximity optical exposure system, and as such is independently variable, unlike the shadow mask which must be used as both a photostencil and an operational shadow mask in the completed tube, it is a comparatively simple matter to adjust the position of the stencil apertures to conform, or register, to the actual electron beam landings which occur in the operational tube. By making successive iterations of the photoexposure stencil 53 from calculations of the known aperture coordinates and comparisons to actual electron beam landings, the number and expense of successive photoexposure iterations will be reduced over that of the lens process and a working lighthouse arrangement will be more quickly and economically arrived at. This is of particular importance where many different tube models are involved.

Further, once an adequate stencil is made, copies may be quickly and easily made by contact photo exposure, unlike continuous compensating lenses which each must be individually formed and polished. Also the stencil may ease the optical requirements of the lens, leading to fewer iterations in making an adequately functional lens. Alternatively, if a constant Q'-height were repeatably attainable in production, the stencil could be constructed to account for all electron beam path variation at a fixed proximity distance, "Q" thereby obviating the need for compensating lenses. The preferred method of aperture location calculation uses a double set of bicubic spline calculations to interpolate all corrected aperture locations from 99 known aperture locations and their measured beam landing errors. A bicubic spline function is used for determining the error components of the beam landings, which vary across the screen in both the X and Y axes, in order to establish corrected aperture locations in conjunction with the selected proximity distance, Q'.

Ordinarily a family of stencils, i.e., grille, red, green, and blue will be photoplotted, keeping in mind that the grille stencil will have 3 times as many apertures as the phosphor stencils, those grille apertures being of slightly smaller size than the phosphor apertures.

Figure 16A:
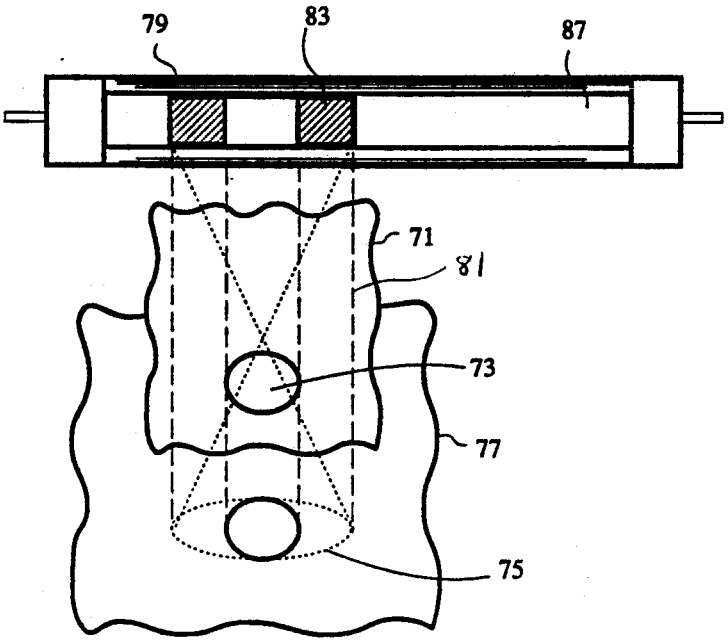
FIGS. 16A and 16B illustrate a stencil producing method using asymmetrical optics proximity exposure.
Figure 16B:
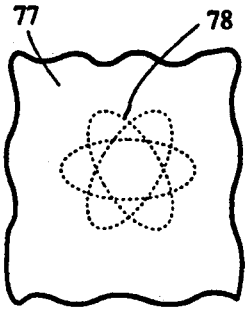

As seen in FIGS. 16A and 16B, an alternative method of stencil formation is to photoplot only one parent, or master, stencil having as many apertures as a phosphor stencil and create a family of stencils therefrom using asymmetric optics and proximity photoprinting. By using asymmetric optics, a variety of stencil aperture shapes may be made from a single master. To do this, a parent stencil 71 having the desired aperture locations is made with the apertures 73 no larger than the desired grille aperture size for the progeny, or working, stencil 77. The progeny stencil aperture 75 is recognized as being a critical controlling factor for screen element formation because the phosphors are deposited on top of the opaque grille material. The phosphor elements are thus defined by the grille apertures 75. The progeny stencil 77 having a photosensitive layer (not shown) thereon, is exposed using a lamp 79 having an oversquare beam 81. The oversquare beam 81 is produced by lengthening a light-emitting orifice of the lamp 83 (shaded area) beyond the fixed dimension of the light-producing lamp bore 87. Hence the term "asymmetric". The oversquare beam 81 will expose, or define, a progency stencil aperture 75, of elongated shape in the lamp axis of the beam 81 on the progeny stencil 77. By controlling the proximity spacing between the parent and progeny stencils, 71, 77 respectively, an enlargement of the progeny aperture 75 produced over that of the parent aperture 73 may be effected. By varying the aspect ratio of the beam and/or the axis of the lamp 79 for multiple exposures in stencil creation, a variety of progeny aperture shapes and sizes may be produced, on different stencils, with each aperture corresponding to the original placement of the parent aperture. As seen in FIG. 16B, three exposures at a different lamp axes create a "cloverleafed" progeny stencil aperture 78. It will further be apparent that the phosphor dot deposition may be made to overlap the black grille material by utilizing the same techniques to slightly increase the phosphor stencil aperture size.

Referring again to FIG. 12, which corresponds to FIG. 3 of U.S. Pat. No. 4,902,257; a lighthouse 89 is equipped with fixtures for proximity photo-printing of the screening surface 8 of the panel 2. The panel 2 is placed, screening surface 8 side down, onto a plurality of posts, or vertical stops 93, at peripheral points beyond the rails 33 so as not to interfere with the screening surface 8 which lies between the rails 33. A pressure device 95 may be used to ensure proper seating of the panel 8 on the stops 93 should the weight of the panel 8 be insufficient to accomplish this purpose. Fiducial marks (not shown) may be included in the panel 2 and the photostencil 52 to insure exact alignment therebetween before photoexposure of the panel 2, in the present and subsequently described embodiments.

As is well known in the art of manufacturing color cathode ray tubes, the lighthouse 89 is used for photoexposing light-sensitive materials applied to the screening surface 8 of the panel 2. Four separate exposures in four different lighthouses are used to produce the grille, or black background pattern, and the three separate colored light emitting phosphor patterns which comprise the screen 12. Standardized photoexposure stencil 52 is permanently installed in lighthouse 89, with the image-carrying layer, or artwork surface 119, facing upward and spaced in proximity to (0.020", e.g.) the inner surface of panel 2. Glass for the stencil should have good transmission in ultraviolet and visible wavelengths, while transmission of the opaque areas should be low. At a fixed distance "f" from the plane of the photoexposure stencil 52 is placed an ultraviolet lamp 97 which emits light rays 53 which simulate the electron beam paths in a completed tube.

A shaded plate 99 modifies the light intensity over the surface of the mask so as to compensate for the variation of distance from the light source and for the variation of the angle of incidence, thereby achieving the desired exposure in all region of the screen. Lens 101 provides for correction of the paths of the light rays so as to simulate more perfectly the trajectories of the electron beams during tube operation.

Experience has indicated that screen patterns produced by following the procedures just described are sufficiently accurate for use in high resolution tubes, provided that the "Q" height of support structure 33, and panel flatness are held to a very close tolerance. While shown in horizontal orientation, it will be appreciated that the panel and lighthouse may be oriented vertically to reduce panel sag, if necessary.

Figure 17:
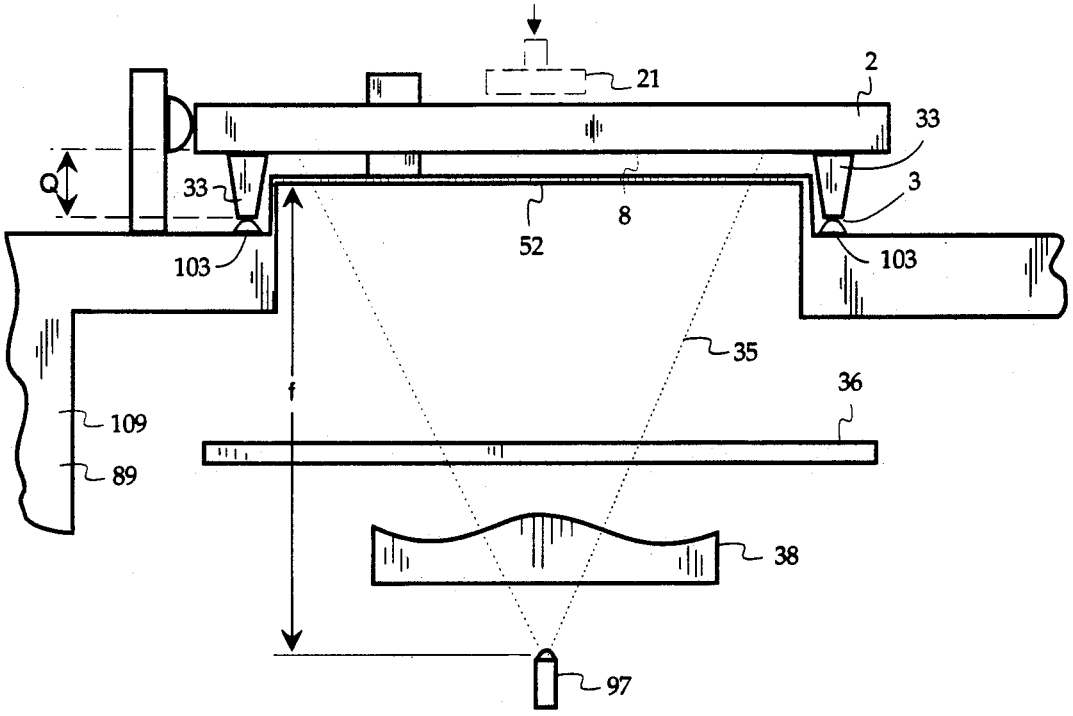
FIG. 17 is an alternative embodiment of FIG. 12 which utilizes compensation factors for increased Q height panels.

A modification of FIG. 12, depicted in FIG. 17 accommodates a wider tolerance in the Q height of the mask support structure or rails 33. Here the vertical stops 93 are replaced by half-balls 103, and the panel 2 rests, not on its inner surface 92, but on the ground mask support surface 3. If for example, the rail 33 on a given panel 2 is 0.002" too high, that panel sits that much higher during exposure, and the light pattern recorded on it is larger than normal. This is exactly what is required; when a mask is eventually affixed to this support structure, it will be 0.002" farther away from the panel, causing the electron beams 53 also to form a larger pattern and thus compensate for the excess vertical height Q. In effect, then, an interchangeable screen is produced in spite of the 0.002" error in support structure height Q.

The process for producing the screen pattern described in connection with the present invention differs from the conventional process in that, for each of the four photo exposures, a standardized stencil 52 is used rather than an individual mask uniquely associated with a particular screen 12. Further, the photostencil 52 and faceplate 2 do not need to be physically attached as in the process using conventional masks actually mounted to the faceplate for each exposure, thus speeding throughput. And the photostencil 52 and screen are both made without inducing projection printing diffusion errors into the system.

Figure 18:
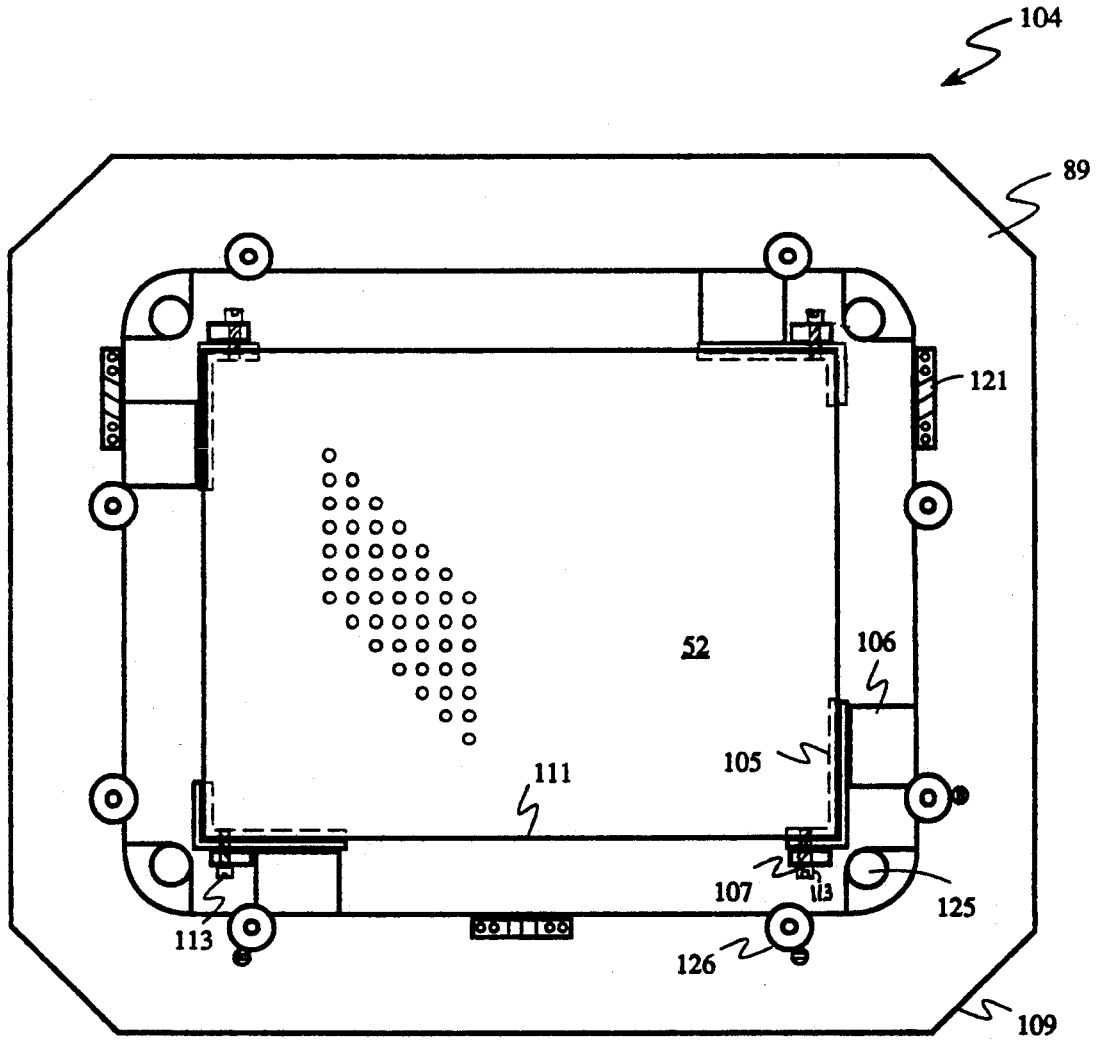
FIG. 18 is a top view of an alternative embodiment of an exposure lighthouse having means for conforming the photostencil to the mask support surface.
Figure 19:
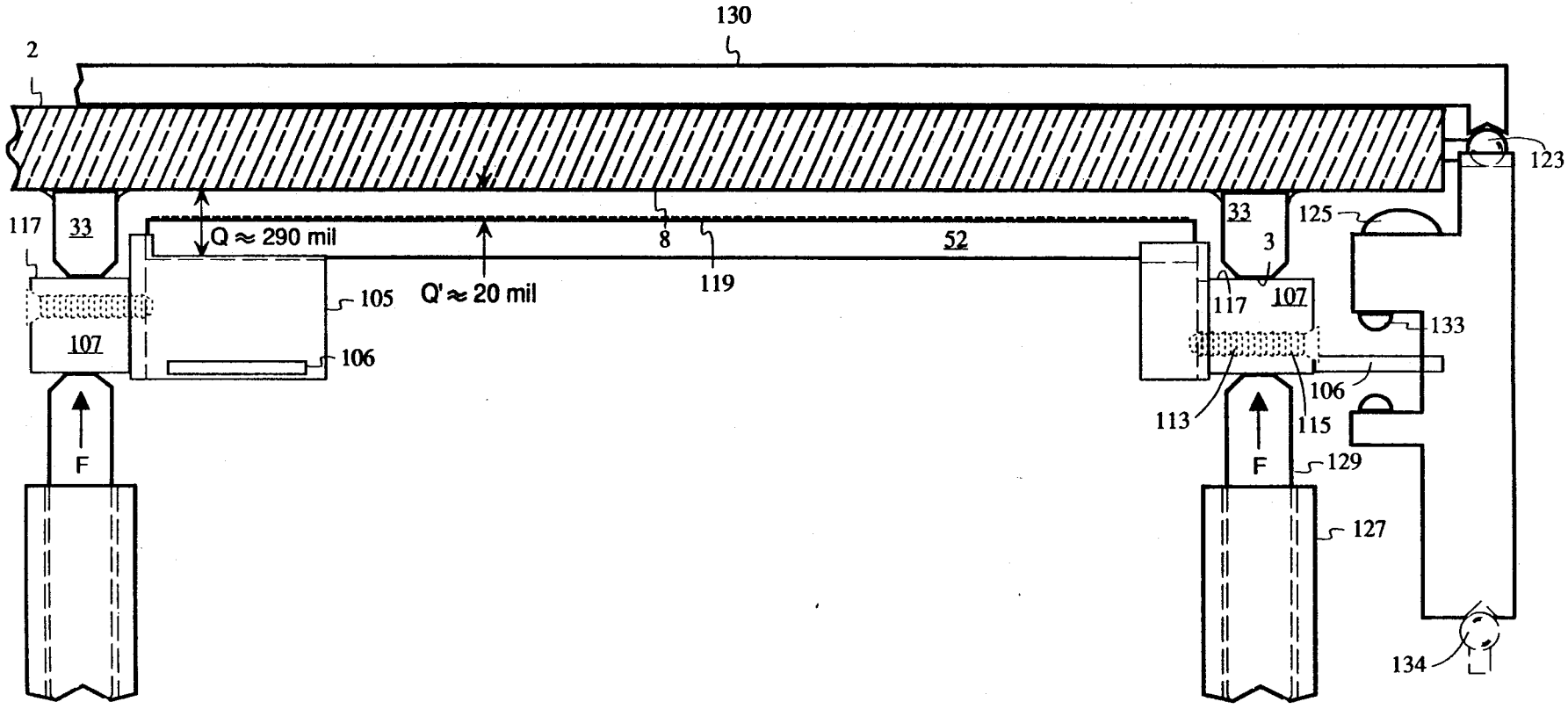
FIG. 19 is a side view of the embodiment of FIG. 17 showing the panel in place thereon.

In order to more fully compensate for any variances in panel planarity, mask support surface planarity, and Q height; an alternate lighthouse embodiment shown in FIGS. 18-19 may be utilized.

As seen in FIG. 18, the stencil 52 has metal "L"—brackets 105 attached to its corners, by gluing or the like. To the "L" brackets 105 are attached reed springs 106 and washers 107. One reed spring 106 is located at each corner of the stencil 52, preferably on the edge perpendicular to that occupied by the adjacent reed spring to limit any rotational component of movement of the stencil 52 on the reed springs, as further explained below. The reed springs 106 are anchored at that end opposite the "L" bracket 105 to the lighthouse frame 109. The reed springs 106 allow the stencil 52 to be movable within the Z-axis as mounted, or suspended, within the lighthouse 89. The reed springs 106 preferably have approximately 30 mils total range of movement.

As best seen in FIG. 19, each washer 107 is connected to the "L" brackets 105 along the long axis 111 of the stencil 52 preferably by a screw 113 passing through an eccentric bore 115 within the washer 107. The eccentric bore 115 will allow the washer 107 to be variably positioned to compensate for any positional variance of the "L" bracket 105 when it is glued to the stencil 52. Typically, such variance is only ±2 mils, but as the artisan will hereinafter appreciate, the washer contact surfaces 117 must be coplanar amongst themselves as well as parallel with the artwork surface 119 of the stencil 52.

The lighthouse frame 109 further has V-grooves 121 for receiving panel mounted balls 123, as seen in FIG. 19, for positioning the panel 52 in the lighthouse 89. Firm stops 125 which will not scratch the panel glass, such as half-balls made of Delrin (TM), may be mounted on the lighthouse frame 109 to prevent the panel 2 from crashing into the stencil 52 should a panel locator ball 123 come unglued from the panel 52. Panel edge guide balls 126 of Delrin (TM) or similar composition are mounted on the lighthouse frame 109 as additional panel positioners to guide the edges of the panel 2 during insertion into the lighthouse 89.

A pin actuator 127 is mounted to the lighthouse 89 and located beneath each washer 107. The pin actuator 127 pushes a pin 129 upwardly into the washer 107 to drive the washer 107 into contact with the mask support surface 3. A counterweight ring 130 is placed over the panel 2 to counterbalance any force from the washer 107 contacting the rails 33 which may tend to displace the panel 2. The attached stencil 52 will concurrently move on leaf springs 106 to place the stencil artwork surface 119 into proximity with the panel screening surface 8 which has been prepared with a photosensitive screen element slurry (not shown). In this manner the topography of the stencil 52 will be conformed to the topography of the mask support surface 3 from which the shadow mask will subsequently be suspended. This mimicry of the mounted mask topography by the standard photostencil thereby provides a compensation factor for irregularities in front panel assembly geometry attendant with rail height Q variance and screen or rail aplanarity. The front panel assembly will include the panel 2 and the attached rails 33 and shadow mask 4. Artwork stops 133 may be mounted on the lighthouse frame 109 to further limit the travel of the stencil 52 in the Z axis. Also, that section of the lighthouse 89 that carries the stencil 52 may be made removable and consistently positionable by ball and V-groove mounts 134 on the base of the lighthouse for easy changeover of stencils during tube manufacture.

Figure 20:
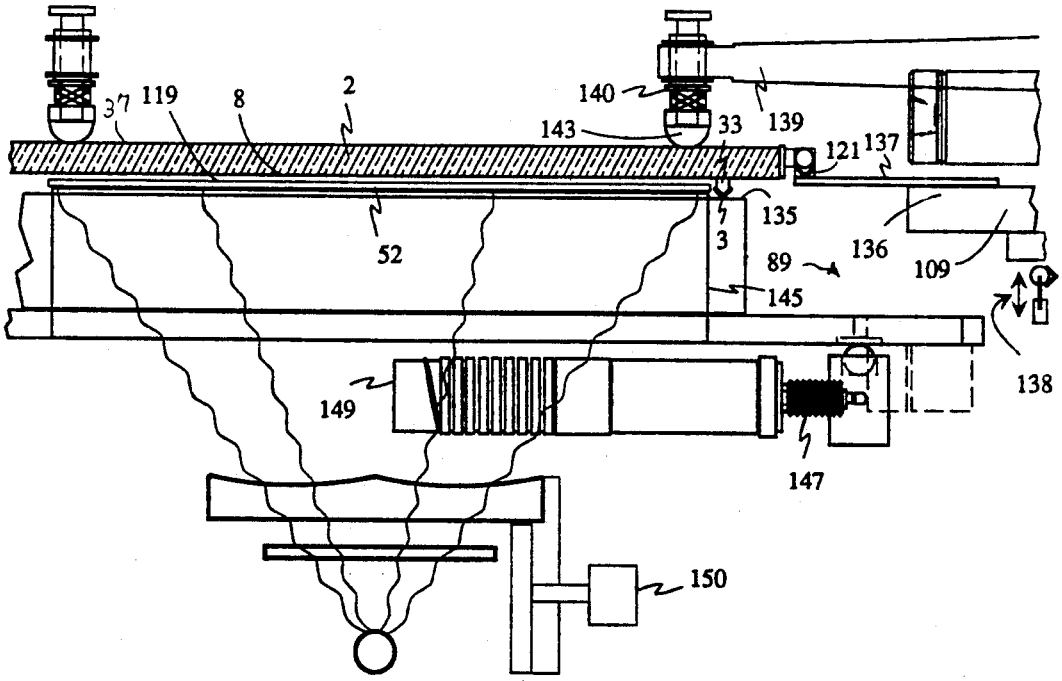
FIG. 20 is a side view of an alternative embodiment of an exposure lighthouse having means for conforming the mask support surface topography coplanar to the plane of the photostencil.
Figure 21:
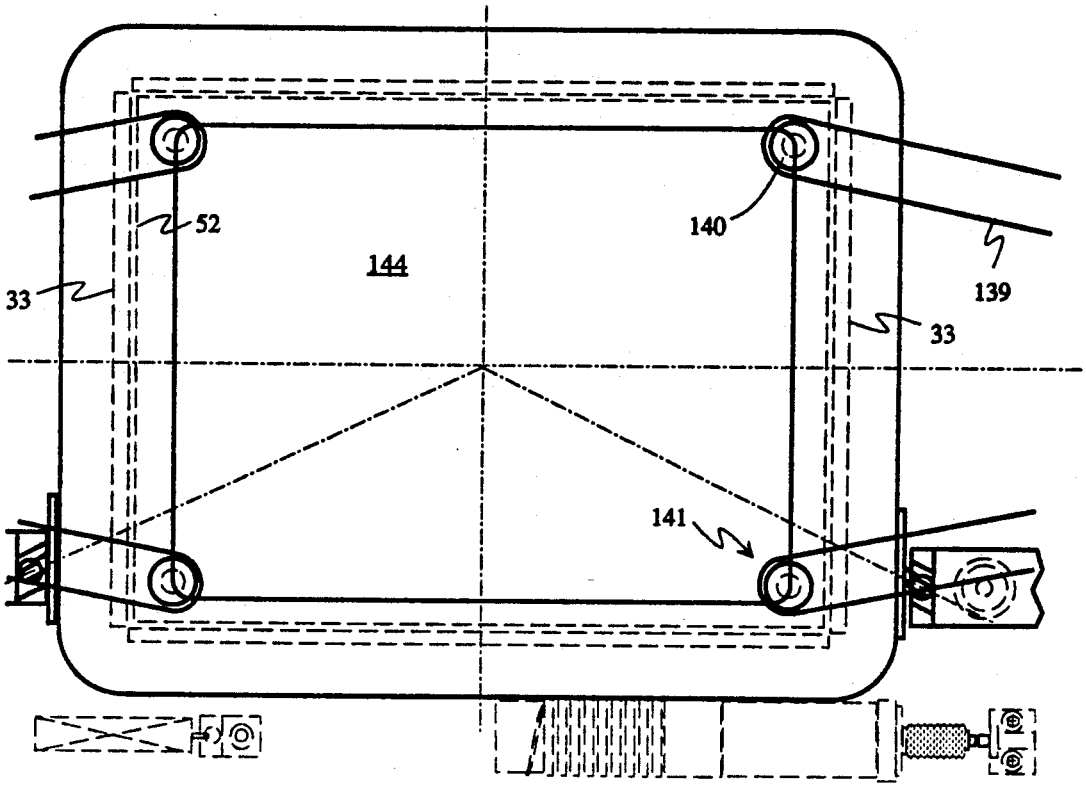
FIG. 21 is a top view of the embodiment of FIG. 19.

As seen in FIGS. 20 and 21, an alternative to the system of conforming the stencil, shown in FIGS. 18 and 19, is a system whereby the panel 2 is deformed to conform the mask support surface 3 topography to a reference plane surface 135 on the lighthouse 89.

Referring to FIG. 20, the panel 2, being convexly warped (FIG. 8A) towards the screening surface 8 by rail attachment, is mounted in the standard ball and groove manner, but in this case the lighthouse grooves 121 are contained on leaf springs 137 mounted on the lighthouse walls 109 to allow for Z-axis movement of the panel 2. Once the panel 2 is suspended on the leaf springs 137, pressure arms 139 having rotary actuators 140 on the ends thereof, are swung into position over the outer panel surface 37 at the corners 141 of the screening area 144 bounded by the mask support rails 33. Contact members 143, incapable of scratching the panel 2 and attached to rotary actuators 140, then apply sufficient force to deform the panel 2 thus conforming the mask support surface 3 to the reference plane surface 135 which is coplanar with the stencil 52. Alternatively, a bladder or line contact apparatus could be used in place of the pressure arms 139 and rotary actuators 140 in order to distribute force more evenly onto the panel 2, if desired.

The stencil 52 is mounted above (as seen in FIG. 20) the reference plane surface 135 so that the artwork surface 119 of the stencil 52 is placed in proximity to the screening surface 8 of the panel 2. The screening surface 8 has, of course, been covered with a screen element slurry (not shown) by this time.

The stencil 52 is suitably mounted in a frame 145 which may be easily replaced in case of damage to the stencil and adjusted in the X and Y axes to the desired screening position by micrometer screws 147 attached to stepping motors 149 or the like. This system of correlating the stencil and mask support topographies has the advantage of eliminating unpredictable panel deformation which may occur in the aforedescribed "warped stencil" system of FIGS. 18 and 19 wherein the pressure used to warp the stencil is transferred to the panel and must be accounted for by the counter weight ring 130 or similar apparatus. In either case, it will be remembered that the dimensions involved in making any of these corrections are only in the order of tenths to ones of mils and do not represent drastic fixturing requirements or forces. It will also be appreciated that the application of conforming forces may be at more points than the four corner points illustrated in FIGS. 18–21 if necessary.

Figure 22:
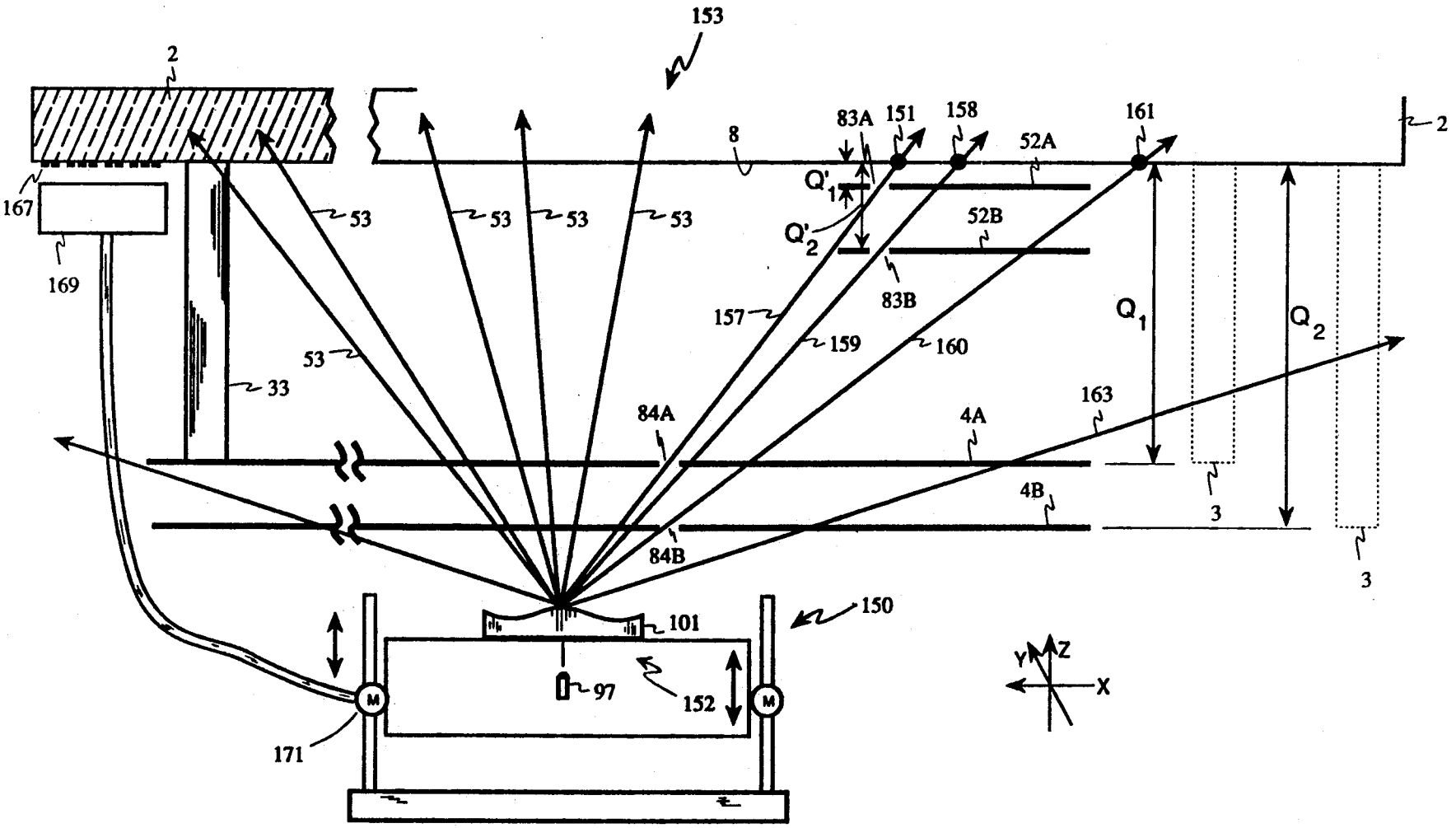
FIG. 22 is a schematic representation of a lighthouse utilizing a light source adjustable in the Z-axis for proximity printing exposure compensation.

As seen in FIG. 22, means 150 for adjusting the lighthouse exposure lamp 97 and lens 101 package, hereinafter light source 152, in the Z-axis is provided to add an additional corrective mechanism in the optical geometry of exposure. By way of explanation and as illustrated schematically in FIG. 22, it will be seen that the light source 152 produces a cone of light 153 having beams 53 traveling outwardly therefrom in fixed paths to simulate the fixed paths of deflected electron beams of the completed tube. That is, the light beam paths through the stencil must print the screen phosphors to register with the electron beams paths through the shadow mask as used to excite the phosphors in the completed tube.

A tube with a nominal mask support surface height Q1 will support a standard shadow mask 4A having an aperture 84A. The standard photostencil 52A is referenced from height Q1 to produce a proximity height Q'1. The photostencil aperture is at position 83A. The photostencil aperture at 83A is fixed to accept a first light beam 157 in line with the mask aperture at 84A. Thus, the phosphor placement will be at the nominal screen position 151. The light and electron beam paths align through the stencil 52A and the mask 4A.

Now assume that the particular faceplate assembly being screened has a greater mask support surface height Q2. The standard shadow mask 4B will now have its aperture in position 84B. The standard photostencil 52B is now referenced from the greater height Q2 to produce a greater proximity distance Q'2. The standard photostencil aperture is now at position 83B. The stencil aperture at 83B accepts a second light beam 159 producing a phosphor placement at a second position 158. However, the Q2 mask aperture at position 84B is not aligned on the second beam path 159. The Q2 mask aperture at 84B accepts a third beam 160 which will produce an electron beam landing in the completed tube at a third position 161. Thus when the mask support surface 3 is varied from its nominal height Q1, the photostencil aperture will not produce a phosphor placement which is aligned with the actual electron beam passing through the shadow mask 4B of the completed tube.

Because the photostencil does move in relation to the Q height variance, some compensation is provided in the proximity screen printing process to place the phosphor element, at position 158, closer to the actual electron beam path 160 through the mask 4B. However, because the photostencil is, e.g., 20 times closer to the screen than ultimately is the mask, this photostencil movement will compensate to place the phosphor element at only approximately one-twentieth of the difference between the nominal phosphor placement 151 and the actual electron beam placement 161.

Therefore, in order to increase the registration compensation factor of the proximity print process, i.e. to help print the phosphor, or screen, element in the desired position according to the actual mask support surface height or Q distance, the light source 152 is moved along the Z axis. This Z axis movement will position the cone of light 153 such that a fourth light beam 163 having an angle of incidence sufficient to produce the actual phosphor placement needed at position 161 will pass through the aperture 83B. As seen in FIG. 22, the light source 152 would be moved upwardly to replace the second beam 159 with the fourth beam 163 having the proper angle of incidence to pass through the Q'2 stencil aperture at 83B to land the beam 163 coincident with the actual electron beam landing at position 161 for that tube.

This Z-axis movement may be automated to accommodate every tube/face panel. For example, upon measuring the rail height after rail grinding, measurement data may be placed in a bar code 167 onto the panel 2 measured. The bar code, 167 although illustrated as being on the panel inner surface 8, may be located on the panel 2 at any convenient location. A bar code reader 169 located in or near the lighthouse 89 may then read the mask support height information and adjust the light source 152 placement through stepping motors 171 operatively connected to the reader 169 and the light source 152. Alternatively, the Z axis movement may be produced by any desired combination of mechanical, optical, and electronic components, whether machine or operator controlled. It is noted that lighthouses have been constructed in the past with light sources adjustable in the Z-axis. However, such adjustment was for purposes of adapting the lighthouse to different tube models or sizes rather than the present purpose of accommodating tube-to-tube variations within a single model.

It will thus be seen from the above discussion that a variety of methods and apparatus may be combined to produce high resolution proximity-printed tension mask CRT screens which are uniquely suited to be combined with interchangeable shadow masks. Although the present invention has been described with respect to specific illustrative embodiments, many modifications thereof will occur to those skilled in the art. All such modifications which fall within the scope of the appended claims are intended to be within the scope and spirit of the present invention. It will be appreciated that each claim whether presented in independent or dependent form represents an embodiment of the invention. Accordingly, the applicant herewith reserves the right to present each claim in independent form as applicant may deem necessary.

Having, thus described the invention, what is claimed is:

1. An apparatus for use in a system of standardized tension mask CRT front panels, comprising:

a) a substantially planar standardized screening stencil for selectively allowing the passage of radiant emissions there through;

b) a fixturing device for holding the standard stencil in proximity to a screening surface of the panel.

2. The apparatus according to claim 1 wherein the fixturing device holds the standard stencil in proximity to the screening surface without attachment of the stencil to the panel.

3. The apparatus of claim 1 wherein the fixturing device holds the standardized stencil in a proximity range determined at the lower value by factors including screen surface deviation tolerance plus slurry thickness; and, at the upper value by significant degradation of screen element morphological definition.

4. The apparatus of claim 3 wherein the lower value is further determined by the distance needed to correct for "Q" height variations from tube to tube.

5. The apparatus of claim 3 wherein the range is from about 1.5 mils to about 100 mils.

6. The apparatus of claim 1 wherein the proximity distance is about 20 mils.

7. An apparatus for use in a system of standardized screening of a flat tension mask CRT having a front panel with rails attached thereto, the rails having mask support surfaces thereon, comprising:

a) a substantially planar standard screening stencil for selectively allowing the passage of radiant emissions therethrough; and, b) a fixturing device for holding the standard stencil in proximity to the screening surface.

8. The apparatus of claim 7 wherein the fixturing device holds the standardized stencil in a proximity range determined at the lower value by screen curvature tolerance plus slurry thickness; and, at the upper value by significant degradation of screen element morphological definition.

9. The apparatus of claim 8 wherein the lower value is further determined by the distance needed to correct for "Q" height variations from tube to tube.

10. The apparatus of claim 8 wherein the range is from about 1.5 mils to about 100 mils.

11. The apparatus of claim 7 wherein the proximity distance is about 20 mils.

12. The apparatus according to claim 7 further including:

means for correlating the mask support topography and the stencil topography.

13. The apparatus according to claim 12 wherein the means for correlating topographies further includes:

means for conforming the stencil topography to the mask support topography.

14. The apparatus according to claim 12 wherein the means for correlating topographies further includes:

means for conforming the topography of the mask support surface to the stencil topography.

15. The apparatus according to claim 14 wherein the means for conforming further includes:

means for applying pressure to the panel so as to conform the mask support surface of the rails to a reference surface which is parallel to the topography of the stencil.

16. The apparatus according to claim 14 wherein the means for conforming the mask support surface further comprises:

a) a fixture for holding the stencil, the fixture being stationary and having stops located a known distance from the stencil; and, b) means for forcing the mask support surface of the rails against the stops, the forcing means being constructed to apply force to the panel substantially at the periphery of the screening surface and in proximity to the rail area of the front panel, so as to place the screening surface in a proximity distance to the stencil, the proximity distance varying in direct proportion to the variance in the mask support surface distance from the screening surface of the front panel.

17. The apparatus according to claim 13 wherein the means for conforming the stencil topography fee further includes:

a) a fixture for holding the stencil, the fixture being movable and having stops located a known distance from the stencil; and, b) means for forcing the stops against the mask support surface of the rails so as to place the stencil in a proximity distance to the screen, the proximity distance varying in direct proportion to the variance in the mask support surface distance from the screening surface of the front panel.

18. An apparatus for use in a system of standardized screening of tension mask color CRT front panels including:

a) a plurality of substantially planar photostencils, each stencil being generated substantially directly from an X-Y photoplotter and without the use of projection printing; and, b) means for holding the stencils in proximity to the front panel.

19. An apparatus for use in a system of standardized screening of CRT front panels comprising:

a) means for adjusting Z-axis distance between a radiant emissions source and the panel so as to compensate for deviations in Q distances between individual CRTs; and, b) a standardized photostencil for selecting transferring light from the radiant emissions source onto the Crt screening surface;

c) means for determining the Q height of an individual CRT; and, d) means for adjusting the light source information according to the Q height determination.

20. The apparatus according to claim 19 wherein the means for adjusting further comprises:

a servomechanism for automatically adjusting the radiant emission source location according to the Q height determination.

21. An apparatus for use in a system of standardized screening of CRT front panels comprising;

a) a source of radiant emissions;

b) a substantially planar standardized photostencil having aperture placements generated in relation to the predicted beam landing areas of a phosphor exciting beam on an operational CRT screen; and c) means for holding the standard photostencil in proximity to the front panel of the CRT.

22. The apparatus according to claim 21 wherein the photostencil aperture placements are generated by a programmable X-Y photoplotter.

23. An apparatus for use in a system of standardized screening of CRT front panels including;

a) a source of radiant emissions;

b) a substantially planar standard photostencil having aperture placements generated according to predicted beam landing areas of an operational CRT phosphor exciting beam as projected along the beam path onto a plane upstream of, and proximate to, the screen; and, c) means for holding the standardized photostencil in proximity to the front panel of the CRT.

24. An apparatus for use in a system of standardized screening of CRT front panels, including a standardized CRT screen printing stencil having:

a) opaque areas; and, b) apertures generated without the use of a CRT shadow mask aperture pattern and projection photoexposure.

25. The apparatus according to claim 24 wherein the stencil aperture placement is further generated according to the placement of apertures on a plane proximate to the CRT screen which will allow the apertures to direct radiant emissions substantially onto electron beam landing areas of an operational CRT.

26. A method for use in a system of standardized screening of a flat tension mask CRT front panel which has a screening surface side and an exterior side, comprising:

a) applying a photosensitive screen element composition layer to a substantially planar screening surface;

b) locating the screening surface side with the composition thereon in proximity to a substantially planar standardized photostencil; and c) passing radiant emissions through the stencil to form a descrete screen element image; and, d) affixing mask supporting rails to the panel screening surface side.

27. The method of claim 26 wherein the screening surface is located in a proximity range from the photostencil determined at the lower value by considerations including screen surface deviation tolerance plus screen element composition layer thickness; and at the upper value by significant degradation of screen element morphological definition.

28. The method of claim 27 wherein the lower value is further determined by the distance needed to correct for "Q" height variations from tube to tube.

29. The method of claim 27 wherein the range is from about 1.5 mils to about 100 mils.

30. The method of claim 26 wherein the proximity distance is about 20 mils.

31. A method for use in a system of standardized screening of a tension mask CRT front panel having rails with mask support surfaces thereon, and a screening surface being located between the rails, comprising:

a) placing a photosensitive screen element composition layer on the screening surface, b) suspending a standardized photostencil between the rails in proximity to the screening surface, and c) passing radiant emissions through the photostencil to form a discrete screen element image.

32. A method for use in a system of standardized screening of a tension mask front panel which has mask supporting rails affixed thereto, comprising:

a) applying a photosensitive screen element composition layer to a front panel screening surface;

b) correlating the topography of a standard photostencil to the topography of the mask support surface of the rails;

c) placing the standardized photostencil in proximity to the screening surface of the panel; and, d) passing radiant emissions through the photostencil to form a discrete screen element image.

33. The method of claim 32 wherein the screening surface is located in a proximity range from the photostencil determined at the lower value by screen curvature tolerance plus screen element composition layer thickness; and at the upper value by significant degradation of screen element morphological definition.

34. The method of claim 33 wherein the lower value is further determined by the distance need to correct for "Q" height variations from tube to tube.

35. The method of claim 33 wherein the range is from about 1.5 mils to about 100 mils.

36. The method of claim 32 wherein the proximity distance is about 20 mils.

37. The method according to claim 32 wherein correlating the topography includes conforming the mask support surface to the topography of the stencil.

38. The method according to claim 32 wherein correlating the topography includes conforming the stencil to the mask support surface topography.

39. A method for use in a system of standardized screening of a flat tension mask CRT front panel which has a screening surface side and an exterior side, comprising:

a) applying a photosensitive screen element composition layer to a substantially planer screening surface;

b) locating the screening surface in proximity to a substantially planer standardized photostencil; and c) passing radiant emissions through the stencil to form a descreet screen element image;

d) a fixing mask supporting rails to the panel screening surface side; and e) adjusting the distance between the source of radiant emissions and the photo stencil according to the distance between the mask support surface of the rails and the screening surface.

40. The method according to claim 39 further comprising adjusting the exposure distance by moving the source of radiant emissions in the Z axis of the front panel.

41. A proximity photoprinting method for screen elements on a CRT front panel, comprising:

a) creating a substantially planar screening surface;

b) coating the screening surface with an photosensitive screen element composition layer;

c) placing a standardized photostencil in proximity to the screening surface; and, d) passing radiant emissions through the photostencil to form a discrete screen element.

42. The method according to claim 41 further comprising: affixing mask support rails to the screening surface.

43. A method for use in a system for standardized screening of a tension mask CRT front panel, comprising:

a) photoexposing a master blank with an X-Y plotter to produce a master artwork pattern;

b) generating substantially planar working stencils from the master; and c) placing the stencils in proximity to a CRT front panel with photosensitive screen elements thereon; and, d) passing radiant emissions through the stencils to create a screen.

44. The method of claim 43 wherein the step of photo exposing a master blank with an X-Y plotter further includes generating a draft master artwork with an X-Y plotter based on a prediction of needed aperture placement utilizing a standard screen generation computer program which accounts for a plurality of tube operation parameters.

45. The method of claim 44 further comprising the steps of:

a) screening a front panel with the draft master;

b) correcting the X-Y values in an X-Y plotter data file based upon observed deviations in the screened front panel;

c) generating a master artwork from the corrected values.

* * * * *